United States Patent [19]

Titchener et al.

[11] Patent Number: 4,763,520

[45] Date of Patent: Aug. 16, 1988

[54] METHOD AND MEANS FOR OBTAINING DATA REPRESENTING A PARAMETER OF FLUID FLOWING THROUGH A DOWN HOLE SIDE OF AN OIL OR GAS WELL BORE

[75] Inventors: Paul F. Titchener, Menlo Park; Michael J. M. Walsh, Kentwood, both of Calif.

[73] Assignee: Comdisco Resources, Inc., San Francisco, Calif.

[21] Appl. No.: 918,252

[22] PCT Filed: Feb. 7, 1986

[86] PCT No.: PCT/US86/00261

§ 371 Date: Oct. 9, 1986

§ 102(e) Date: Oct. 9, 1986

[87] PCT Pub. No.: WO86/04635

PCT Pub. Date: Aug. 14, 1986

Related U.S. Application Data

[63] Continuation-in-part of Ser. No. 700,352, Feb. 11, 1985, abandoned.

[51] Int. Cl.[4] ..... E21B 47/06

[52] U.S. Cl. ..... 73/155; 367/83

[58] Field of Search ..... 367/83, 81; 73/155, 73/152; 340/856, 857, 858, 859; 324/351, 353

[56] References Cited

U.S. PATENT DOCUMENTS

| | | | |
|---|---|---|---|
| Re. 21,102 | 5/1939 | Jakosky . | |
| 1,991,658 | 2/1935 | Clark et al. . | |
| 2,172,625 | 9/1939 | Schlumberger . | |
| 2,225,668 | 12/1940 | Subkow et al. . | |
| 2,242,612 | 5/1941 | Leonardon . | |
| 2,350,832 | 6/1944 | Segesman . | |
| 2,393,009 | 1/1946 | Chun | 324/366 |
| 2,400,170 | 5/1946 | Silverman . | |
| 2,826,736 | 3/1958 | Doll . | |
| 3,434,046 | 3/1969 | Wilson et al. . | |
| 3,437,992 | 4/1969 | Johnston . | |
| 4,035,763 | 7/1977 | Cowles . | |
| 4,057,781 | 11/1977 | Scherbatskoy . | |
| 4,236,113 | 11/1980 | Wiley . | |
| 4,286,217 | 8/1981 | Planche et al. . | |
| 4,468,665 | 8/1984 | Thawley et al. . | |

FOREIGN PATENT DOCUMENTS

| | | |
|---|---|---|
| 81/03382 | 11/1981 | World Int. Prop. O. . |
| 1557863 | 12/1979 | United Kingdom . |

OTHER PUBLICATIONS

J. Bhagwan & F. N. Trofimenkoff, I.E.E.E., "Transactions on Geoscience & Remote Sensing", vol. GE-20, No. 2, Apr. 1982.

Oil & Gas Journal, Feb. 21, 1983, pp. 84–90.

*Primary Examiner*—Jerry W. Myracle

*Attorney, Agent, or Firm*—Christie, Parker & Hale

[57] ABSTRACT

Method and apparatus are disclosed for recovery of data in an oil or gas well having a well bore (20*a*) for passing fluid (54), transversely across a side (29*a*–29*b*) of the well bore, at a down hole location (29*a*–29*b* ) of the well bore and longitudinally in the well bore, between a geological formation (44) located at the down hole location and a top portion (22) of the well bore. A sensor (30) senses, substantially at the down hole location, a parameter of the fluid. A transmitter (28) transmits into the well bore, data signals which represent the sensed parameter. A receiver (34) and a flexible line (36) are lowered in the well bore separate from the sensor and transmitter, while the receiver is suspended from the flexible line. The data signals from the transmitter are received with the receiver. Data signals, which represent the parameter, which is represented by the received data signals, are passed over the flexible line to the top portion of the well bore.

98 Claims, 22 Drawing Sheets

40
20
38
PROCESSING
DISPLAY/STORAGE
22
58
56
54
42
63
46
24
52
60
20a
36
34
29a
48
44
29
29b
28
31
30

METHOD AND MEANS FOR OBTAINING DATA REPRESENTING A PARAMETER OF FLUID FLOWING THROUGH A DOWN HOLE SIDE OF AN OIL OR GAS WELL BORE

This application is a continuation in part of copending application Ser. No. 700,352, filed Feb. 11, 1985, now abandoned.

CROSS REFERENCES

The patent applications whose titles, serial numbers and filing dates are noted below have the same inventors as the present patent application and disclosure subject matter which is common to the present patent application: Telemetry System Using an Antenna, U.S. Ser. No. 700,352, now abandoned filed Feb. 11, 1985, priority of which is claimed herein; Method and Apparatus for Data Transmission in a Well Bore Containing a Conductive Fluid, filed Oct. 9, 1986, under Ser. No. 934,610 and claiming priority of said U.S. Ser. No. 700,352 now abandoned; and Method and Apparatus for Data Transmission in a Well Using a Flexible Line with Stiffener, filed Oct. 7, 1987, under Ser. No. 109,306.

FIELD OF THE INVENTION

This invention relates to method and apparatus for communicating data from a down hole location in a well while fluid is flowing between the down hole location and a top portion of the well.

BACKGROUND OF THE INVENTION

Oil and gas wells are known having a well bore for passing fluid, transversely across a side of the well bore at a down hole location of the well bore and longitudinally in the well bore, between a geological formation located at the down hole location and a top portion of the well bore. The pressure of the fluid flowing across the side of the well is an important parameter to know by operators at the top of the well. Other parameters of the fluid as it flows across the side of the well may also be important to know at the top of the well. For example, during fracturing, when fluid is passed into the geological formation, pressure at the down hole location is important in determining whether a fracture is vertical or horizontal and to determine growth parameters of the fracture. Fluid pressure and temperature at the down hole location of a producing well, where fluid is flowing from the geological formation to the top of the well, may also be important in some situations. However, remoteness of the down hole location from the top of the well, high flow rates of the fracture fluid across the side of the well and the harsh environment down hole create difficulties in reliability recovering data representing the pressure and other parameters from the fluid at the down hole location.

Therefore, a need exists for easy to use apparatus and methods for recovery, at the top of a well bore, data which accurately and reliably represents a parameter, particularly pressure, of a fluid and particularly a fracture fluid, as that parameter exists in the fluid flowing through the side of the well at the down hole location.

SUMMARY OF THE INVENTION

Briefly, method and apparatus is disclosed herein for recovery of data in an oil or gas well having a well bore for passing fluid, transversely across a side of the well bore at a down hole location of the well bore and longitudinally in the well bore, between a geological formation located at the down hole location and a top portion of the well bore.

Briefly, the method involves sensing with a sensor, substantially at the down hole location, a parameter of the fluid. A transmitter transmits into the well bore, data signals which represent the sensed parameter. A receiver and a flexible line are lowered in the well bore, separate from the sensor and transmitter, while the receiver is suspended from the flexible line. The data signals are received with the receiver. Data signals, which represent the parameter, which is represented by the received data signals, are passed over the flexible line to the top portion of the well bore.

Preferably, the transmitter transmits the data signals substantially from the down hole location.

In one embodiment a string of annular members are positioned in the well bore for passing the fluid between the top portion and a lower portion of the well bore. The receiver and flexible line are lowered in an annulus left between the string of members and the well bore. In such an arrangement the sensor, preferably, senses the parameter of the fluid in the central passage of the string of members. In one arrangement, the parameter is sensed through a side of the string of members. In one arrangement the string of members is lowered in the well bore with the sensor, and preferably the transmitter, mounted on the string of members.

Preferably the sensed parameter, is pressure of the fluid.

The flexible line preferably contains an insulated conductor and in a preferred arrangement, has a metal exterior sheath. Preferably the flexible line is a conventional wire line used in the oil industry.

In one preferred arrangement the formation is fractured while performing the step of transmitting and receiving by passing, as a fluid, a fracture fluid down the well bore and then transversely across a side of the well bore between, what is termed, up hole and down hole extremities of a zone located at the down hole location. Preferably, with this arrangement, the flexible line and the receiver are positioned so that the receiver is substantially up hole from the zone up hole extremity. Also preferably, the sensor and transmitter are positioned substantially down hole from the zone down hole extremity. Preferably the sensor and transmitter are displaced away from in front of the zone. One embodiment with the string of annular members, has the string of members moved with a tool, the sensor and the transmitter mounted thereon longitudinally along the well bore, leaving the annulus between the string of members and the well bore. The flexible line and receiver are moved such that the receiver follows the transmitter within a range for receiving the data signals from the transmitter. Preferably with this arrangement the string of members are incrementally moved so as to move the tool to each of a plurality of positions and the flexible line is moved incrementally so that the receiver is, thereafter in range for receipt of the data signals from the transmitter. Preferably the tool comprises a perforation wash tool for passing fluid to one of the perforations in the zone of the casing to which the fluid is passed.

One arrangement with the tubing string has an annulus closing apparatus, such as a packer, which is actuated to close off the annulus. The receiver and flexible line are left in the annulus above the packer and the sensor and receiver are left below.

A number of advantages can be achieved by embodiments of the present invention.

For example, easy to use apparatus and method may be achieved for recovery, at the top of a well bore, data which accurately and reliably represents a parameter of a fluid as that parameter exists in the fluid flowing across the side of the well at the down hole location.

It is not necessary to raise and lower the receiver between readings.

Also, the sensor and transmitter can be positioned closely adjacent the location where the fluid flows across the side of the well bore to sense the parameter and transmit data signals representing the parameter. Separately, from the transmitter and sensor, the receiver may be lowered on the flexible line in the bore hole until within range for receiving the data signals and passing corresponding data signals over the flexible line to the top of the well bore.

It is also possible to position, and reposition, the receiver after the well bore casing is set. Additionally, the receiver can be lowered on the flexible line to a position closely adjacent to the transmitter. It is unnecessary to reattach the receiver to casing or the like.

Additionally, there is no obstruction to the flow of fluid within the tubing where the receiver and the line are positioned in the annulus between tubing and the well bore. Also placing the line in the annulus and passing the fracturing fluid down the tubing string minimizes any downward pull or drag on the line that otherwise would be present if the fracturing fluid flows in contact with the wire line.

With arrangements where there is a tubing string inside of a well bore, it is desirable to make the tubing string as large in diameter as possible, relative to the inside of the well bore, causing the annulus spacing to be quite small. As a result there is a very little room for passing parts down the annulus. Since a receiver can be made quite small, by mounting only the receiver on a flexible line it is possible to pass or feed the line down the annulus. Minimizing the obstruction to the line in the annulus by minimizing the parts hung on the line as it is passed down the annulus is of importance. The larger parts, such as the transmitter, sensor and the battery supply are separated from the receiver and may be either mounted on the tubing string as it is lowered or dropped (i.e. air mailed) down the bore hole in a common module to the desired position for sensing and transmitting. If the transmitter, sensor and battery are air mailed, this can be done down the inside of the tubing string or down the well bore prior to insertion of the tubing.

Where the tubing string is used, a tool, as well as the receiver and the sensor, may be mounted on the tubing string and moved to a plurality of positions. The flexible line and the receiver may be moved so as to follow the transmitter and stay in range for the receiver to receive the data signals from the transmitter.

DETAILED DESCRIPTION OF THE PREFERRED EMBODIMENTS

Figure 1:
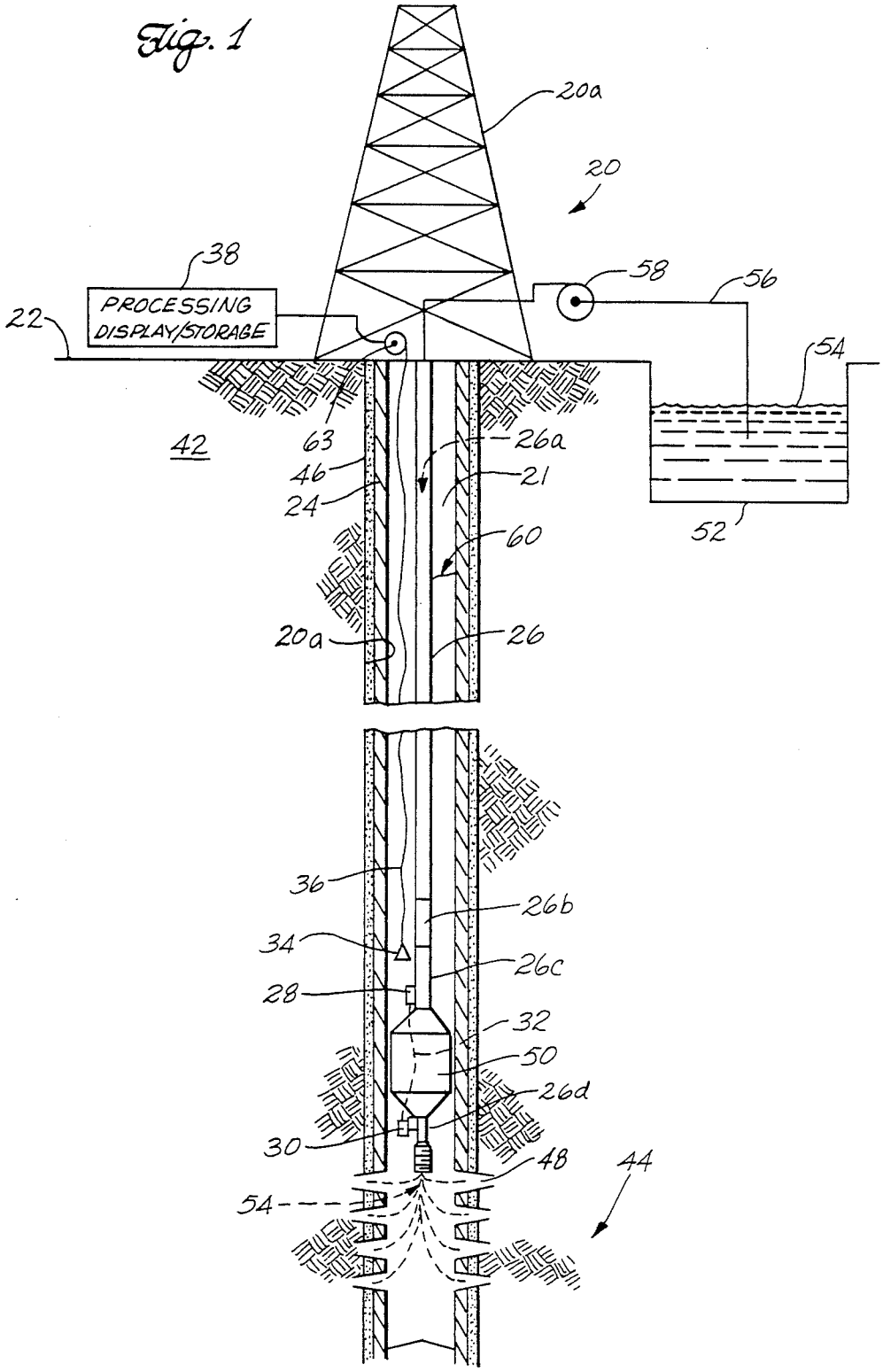
FIG. 1 is a schematic of an oil or gas well showing tubular casing and cement in cross-sectional view to reveal the interior of the well bore. A wire line and receiver are in the annulus between the tubing string and casing and a pressure sensor is mounted on a tubing string below the packer, and embodies the present invention.

FIG. 1 is a schematic and partial cross-sectional view of an oil or gas well 20 and depicts method and apparatus for obtaining from down hole, data signals representing a parameter, preferably pressure, in the well. The well has a tubular casing 24 inside of a well bore 20*a*, and a tubing string 26 disposed within a central passage of the casing with a transmitter 28 mounted on tubing string for transmitting data. There is a space or annulus 21 below the tubing and casing. A sensor 30 is mounted on the tubing string and is coupled to the transmitter through an electrical conductor 32. The sensor senses a parameter, such as pressure, in the well and communicates the parameter to the transmitter which sends data signals representing the parameter into the annulus 21.

A receiver 34 is suspended on a wire line 36 in the annulus 21 at a location for receiving the data from the transmitter. Data signals representing the parameter are conducted up the wire line to the top of the well over the wire line. Processing, display and storage apparatus 38 is coupled to the wire line at the top of the well for receiving and processing the data signals from the wire line and for displaying and recording the parameter for the user.

The well extends into the earth 42 to a geologic stratum or formation 44 from which oil or other hydrocarbons are to be produced. The invention is especially well suited for wells that may extend anywhere from 5,000 to 20,000 feet or more below the surface. Though the apparatus and method, according to the present invention can be used in shallower wells, it is especially well suited for deeper wells. The casing 24 extends from the surface of the well to and beyond the geologic formation 44, and is cemented in and interior of the bore hole in the well with cement 46. To retrieve oil or gas from a region in the area of the well, one or more openings or perforations 48 are made in the casing and cement, using conventional techniques, for allowing flow of a fluid 54 between the interior of the string 26 and the formation 44. The fluid may be oil, water or fracturing fluid, but preferably a fracturing fluid is applied under pressure at a high flow rate through the tubing and perforation to the formation for opening up or enlarging a fracture on the formation.

A generally cylindrical shaped packer 50, having a central passage, in communication with the central passage of the string, through which the fluid flows, is connected in the lower portion of the tubing string 26 for substantially closing off the annulus 21 between the exterior of the tubing string and the casing above the perforations 48. The sensor 30 is mounted on a pipe or tubular member 64*d* of the tubing string immediately adjacent to and below the packer with the conductor 32 extending through the packer 50 to the transmitter 28. In an alternative embodiment, the conductor 32 may be affixed to and extend outside the packer to the transmitter. The transmitter is mounted on the tubing member 26*c* immediately adjacent to and above the packer.

A basin or tank 52 holds the fracturing fluid 54. Fluid 54, under the pressure developed in pump 58, is supplied through a supply line 56, through the central passage 26*a* of tubing string 26, through the packer 50 and through the perforations 48 to the formation.

The well bore need not be cased the entire length but an uncased portion can be left much as a rat hole at the bottom of the well bore.

In operation, the transmitter, sensor and packer are mounted to the tubing members of the tubing string and the tubing string is lowered with the transmitter and sensor to the desired position for the packer while the packer is radially collapsed. The tubing string lowering mechanism is located in the surface equipment 20*a*, and is conventional in the art and therefore is not shown and described in detail. The position of the packer and sensor is immediately adjacent to and above the perforations 48. The packer is conventional, in that it is enlarged or radially actuated to contact the casing, and seal off the annulus 21 above the packer to the area below the packer. The receiver 34 is then lowered down the annulus 21 by means of, and supported at the lowered down the annulus 21 by means of, and supported at the end of wire line 36 to a position adjacent the transmitter so that data signals formed in the annulus by the transmitter can be received by the receiver. The pump is then started and the fracturing commences. Electronics in the sensor, in the transmitter and, to the extent present, in the receiver are active during the process of fracturing. For example, a start timer may be included in the transmitter which times out and activates the electronics. Alternatively, the electronics operations may be initiated before the tubing and packer are lowered in place.

As the fracturing fluid is forced through the perforations 48 and into the surrounding region the flow is impeded by the earth formation so that pressure is developed in the area of the perforations. The pressure is sensed by sensor 30 which produces signals for transmitter 28 which are a function of and represent the pressure. The signals are manipulated or processed as desired and data signals representing the pressure are sent into the annulus 21 by transmitter 28 to, and are received by, the receiver 34. Data signals representing the pressure are then conducted along wire line 36 to the processing display and storage apparatus 38 for analysis, and display and/or storage.

The wire line is wound on a reel 63 at the top of the well. The receiver is made up on the end of the wire line and then the reel is rotated to unwind the wire line and lower the receiver down the annulus 21 or disconnected above. Preferably the lowering of the receiver is done after the transmitter is lowered into place.

Figure 2:
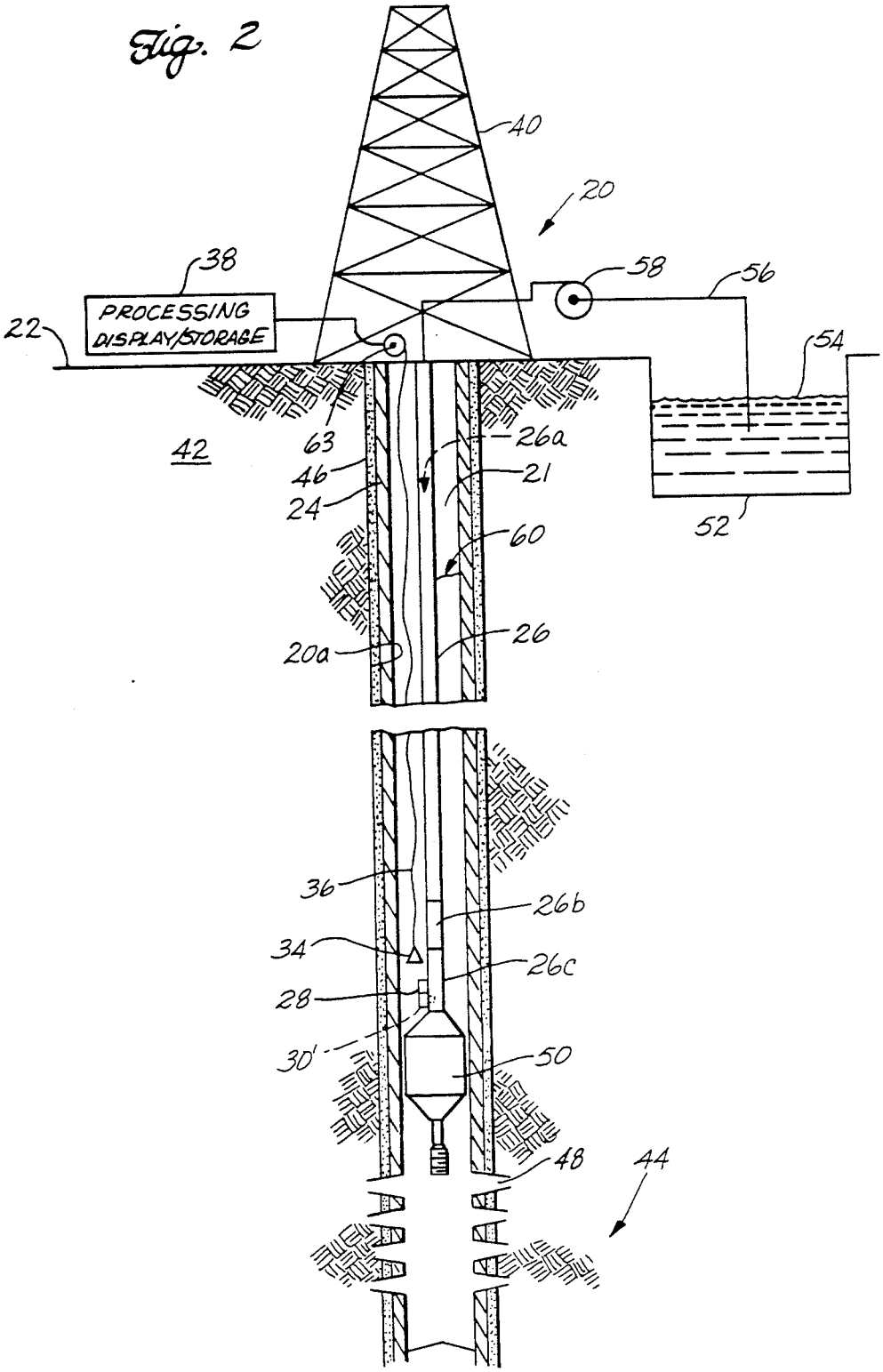
FIG. 2 is a schematic and partial cross-sectional view similar to FIG. 1 showing the pressure sensor on the tubing string above the packer, and embodies the present invention.

FIG. 2 is a schematic and cross-sectional view, similar to that depicting FIG. 1, except that the transmitter and receiver are both mounted on tubing member 26*c* of the tubing string 26 above the packer 50 and in the annulus. In this arrangement the sensor 30' has its pressure sensing mechanism tapped or connected through the wall of the tubing string to the central passage so that fluid pressure inside of the tubing string is sensed. The transmitter 28 sends data signals representing the sensed pressure into the annulus 21 to the receiver 34 as discussed in connection with FIG. 1.

Figure 2A:
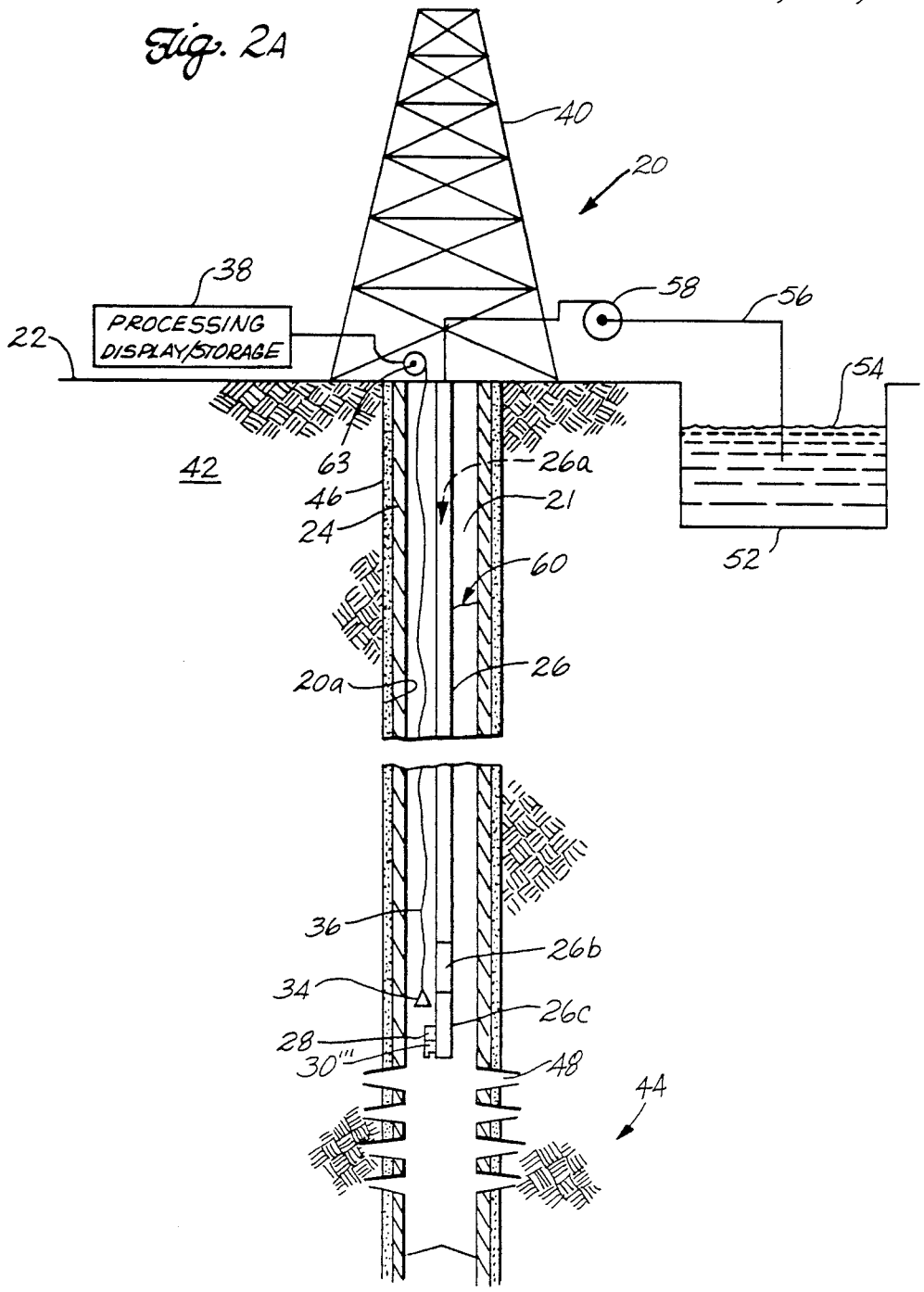
FIG. 2A is a schematic and partial cross-sectional view similar to FIG. 2 without a packer on the lower end of the tubing string.

FIG. 2A is an alternate arrangement similar to FIG. 2 where a packer is not used, and an alternate pressure sensor 30''' is employed which senses pressure in the annulus and hence in the central passage of the casing at the end of the tubing string. Means (not shown) is provided at the top of the well to seal the annulus and prevent fluid from passing upward out of the annulus. This arrangement allows bottom hole pressure to be sensed and communicated to the top of the well in a completed well during fracturing as desired. This arrangement allows the fracturing fluid to be passed down the tubing string so that the flow of fluid is out of direct contact with the wire line and minimizes downward drag force on the wire line.

Figure 3:
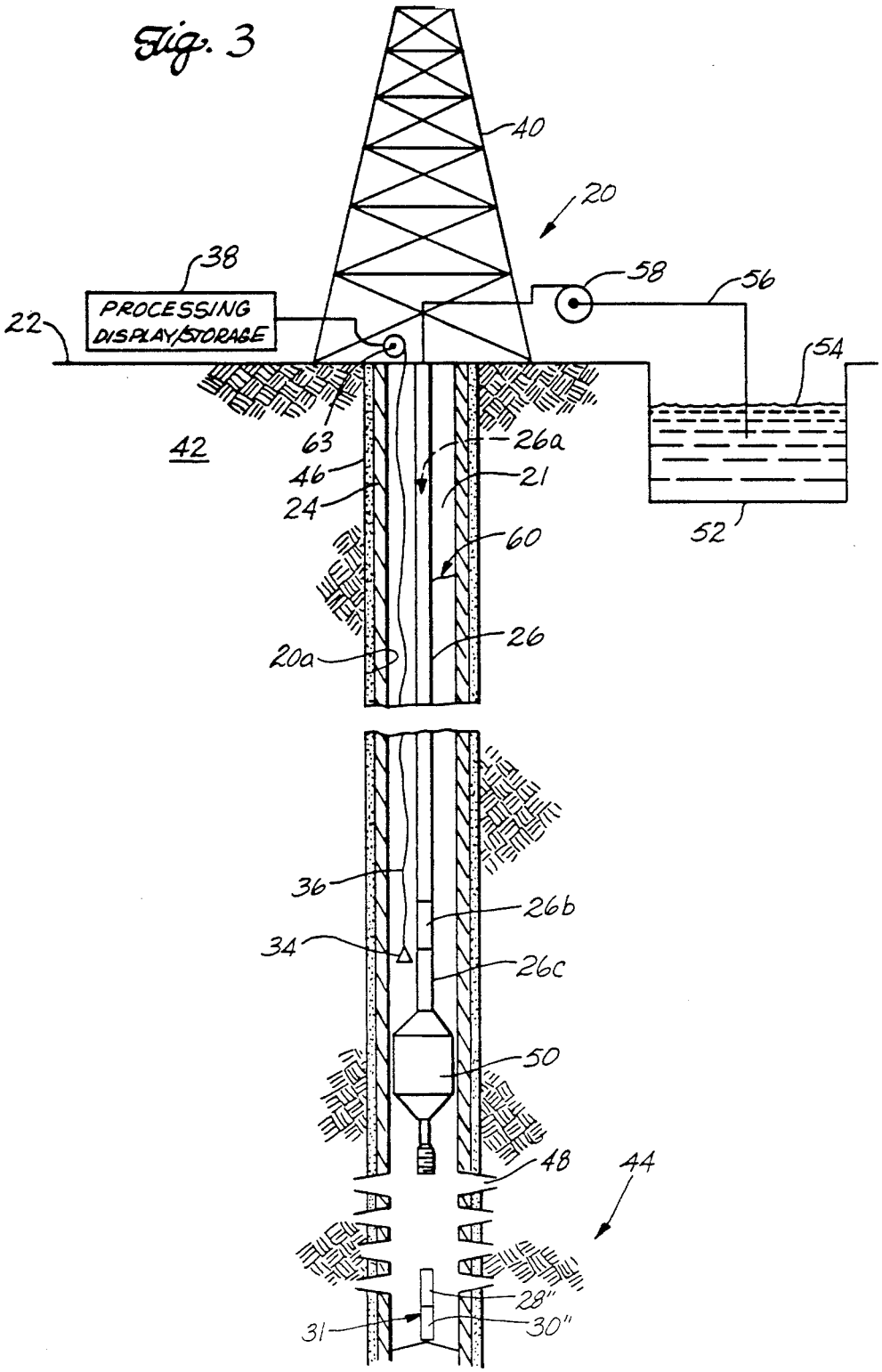
FIG. 3 is a schematic and partial cross-sectional view similar to FIG. 1 showing the pressure sensor and a transmitter at the bottom of the well bore, and embodies the present invention.

FIG. 3 depicts a further alternate arrangement similar to that depicted in FIG. 1 wherein the sensor and transmitter, instead of being mounted on he tubing string 26, are dropped down the central passage 26*a* of the tubing string 26, or are dropped down the central passage of the casing 24 prior to insertion of the tubing string 26, and allowed to come to rest at the bottom of the well bore or on a plug in the well. Transmitter 28'' and the sensor 30'' are housed in a common module or housing indicated at 31 in FIG. 3. When enclosed in a common module the sensor and transmitter can be dropped down the tubing string or the casing and allowed to come to rest at the bottom of the well under the pull of gravity or can be assisted in its downward movement by the force of pressurized fluid being pumped down the tubing string or casing. It is possible that the sensor and transmitter will be located below the casing, but of course, still in the well bore.

Preferably the wire line includes a central insulated conductor which extends to the top of the well bore. The data signals representing the pressure parameters transmitted by transmitter 28 are received by receiver 34 and data signals representing the parameter are conducted up to the top of the well bore over the insulated conductor contained in the wire line. The wire line may be constituted in a number of different ways, but must be of suitable strength to support the receiver and withstand the harsh environment in the annulus 21, and must extend from the desired position of the receiver (as close as possible to the transmitter) to the top of the well.

The wire line may be an insulated coaxial cable. However, preferably the wire line is similar to that conventionally used in the oil tool art, and as depicted at 36 in FIG. 4 has a central insulated conductor 36*a*, insulation 36*b* surrounding the central conductor 36*a* and an outer metal sheath or jacket 36*c* which protects the wire line from the abrasive effects of the fluid and other materials in the well with which it comes in contact when in or moving down the annulus of the well. The wire line 36, including the central conductor 36*a*, the insulting 36*b* and the jacket 36*c* extend to the top of the well, and are wound on the reel 63. The wire line and its components are sufficiently flexible so that they can be wound on a reel. Preferably the conductor 36*a* is stranded.

What has been disclosed in FIGS. 1, 2, 2A and 3 is a method and apparatus for recovery of data in an oil or gas well having a well bore 20*a* for passing fluid 54, transversely across a side 29*a* to 29*b* of the well bore, at a down hole location of the well bore and longitudinally in the well bore, between a geological formation 44 located at the down hole location and a top portion of the well bore. Briefly, a sensor 30 senses, substantially at the down hole location, a parameter of the fluid. A transmitter 28 transmits into the well bore, data signals which represent the sensed parameter. A receiver 34 and a flexible line 36 are lowered in the well bore separate from the sensor and transmitter, with the receiver suspended from the flexible line. The data signals are received with the receiver. Data signals, which represent the parameter, which is represented by the received data signals, are passed over the flexible line to a top portion 22 of the well bore. In the disclosed embodiments of FIGS. 1, 2, 2A and 3, a string of annular members 26 are positioned in the well bore for passing the fluid between the top portion and a lower portion of the well bore. The receiver and flexible line are lowered in an annulus left between the string of members and the well bore.

Figure 3A:
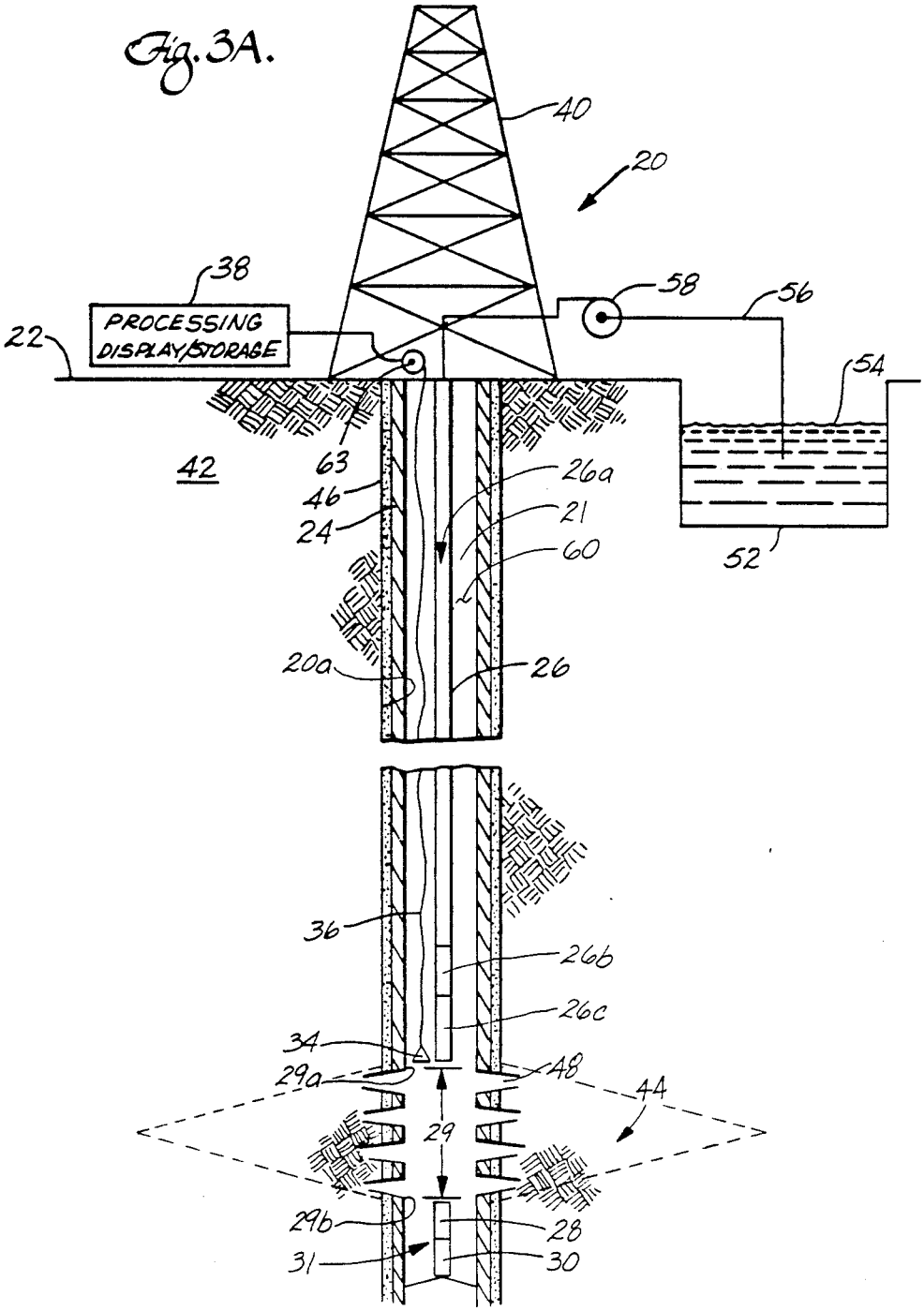
FIG. 3A is a schematic and partial cross-sectional view of an oil or gas well in which a formation is being fractured and showing tubular casing and cemented in cross-sections to reveal a receiver suspended on a wire line in an annulus between the well bore and a tubing string and a sensor and transmitter.

FIG. 3A depicts an alternate embodiment of the invention similar to FIG. 3, except that the packer 50 is eliminated and the fracture fluid is passed down the tubing string through casing perforations 48, which extend between an up hole side 29*a* and a down hole side 29*b* of a zone 29 in the well bore. The casing perforations, as discussed above, extend through the casing and cement to the adjacent formation 44 allowing fracture fluid to pass through the tubing string to zone 29 into the formation 44 where the formation is fractured or separated under the force of the fracture fluid passed by pump 58.

Additionally, the wire line 36 is lowered so that the receiver 34 is substantially at the up hole side 29*a*. The sensor and transmitter are supported substantially at the down hole side 29*b* of the zone 29. Preferably, the receiver 34 is above the up hole side 29*a* and the sensor and receiver are below the down hole side 29*b* and, therefore, out from in front of the perforations in the zone 29 allowing the fracture fluid to freely flow unobstructed through the perforations to the adjacent formation.

Figure 3B:
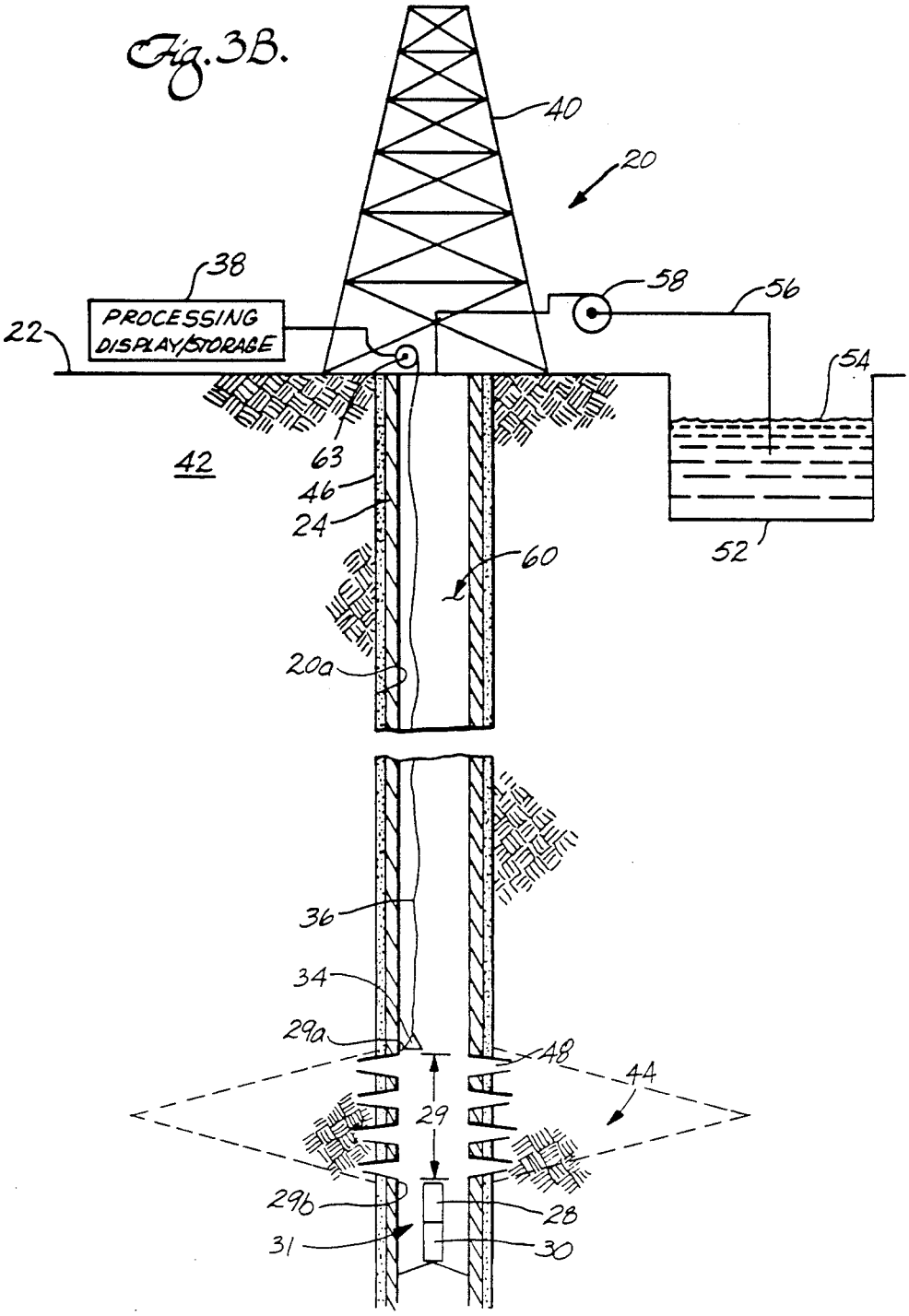
FIG. 3B is a schematic and cross-sectional view similar to FIG. 3A without the tubing string.

FIG. 3B depicts an oil and gas well which is essentially the same as FIG. 3A, except that the tubing string is eliminated. Similar reference numerals used are FIGS. 3B and 3A to identify the some or similar elements.

It will now be appreciated that FIGS. 3A and 3B depict an arrangement similar to that depicted in FIGS. 1, 2, 2A and 3 with the refinement that the flexible line and the receiver are lowered until the receiver is at a position, which is substantially up hole from the zone up hole extremity 29*a* and the sensor and transmitter are lowered to a position which is substantially down hole from the zone down hole extremity 29*b* where the sensing, transmission and receiving take place. Preferably, the flexible line are positioned so that the receiver is at a location displaced away from in front of the zone and up hole from the zone up hole extremity and the sensor and transmitter are displaced away from in front of the zone and down hole from the zone down hole extremity.

It is typical in the well drilling art to make up the tubing string out of a number of separate pipes or annular members threaded end to end. The packer 50 and sensor and transmitter connected to the tubular string are lowered into the well by adding pipes one at a time to the uppermost end of the tubing string, lowering the tubing string with the connected packer into the well.

It will be understood by those skilled in this art that procedures need to be followed to prevent the inlet to the sensor from plugging up with particles from the fluid. This may be accomplished by making the sensor opening large enough that the particles do not wedge in the opening or by positioning the pressure sensing surface flush with the opening to the sensor.

Figure 4:
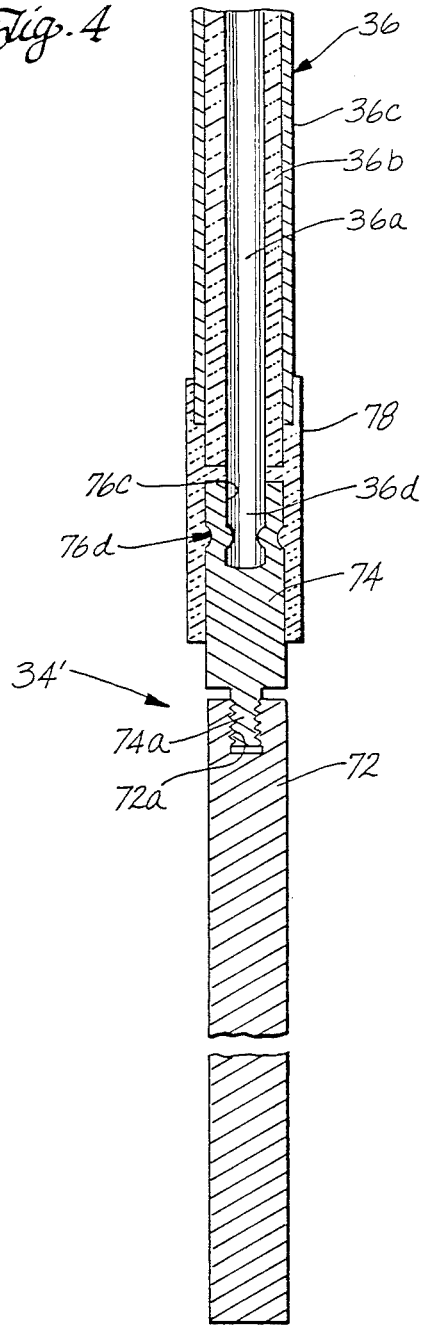
FIG. 4 is a cross-sectional view of a wire line and a receiver for receiving potentials from a conductive fluid for use in the systems of FIGS. 1–3.

Refer now to FIG. 4 and consider the preferred form of the receiver. A receiver 34' is shown which is for use with a conductive fluid 60, in the annulus 21 and is adapted for receiving electrical potentials or data signals, representing the sensed parameters, which are created in the conductive fluid.

The receiver is comprised of an electrically conductive, elongated and cylindrical shaped metallic conductor or electrode 72. The electrode 72 is preferably copper plated steel and is exposed so that it will be in electrical contact with the surrounding conductive fluid. The electrode 72 is suspended at the end of wire line 36 by means of a cylindrical shaped coupler 74, which is affixed, preferably by crimping 76*d* to the lower end of the insulated conductor 36*a* from which the insulation 36*b* has been stripped. The coupler 74 is an electrically conductive material having an axial bore into which the end of the insulated conductor 36*a* is inserted and crimped. The crimping provides a rigid mounting or attachment, as well as a good electrical connection to the end of the insulated conductor 36*a*. The coupler 74 also has a threaded coaxial extension 74*a* which is smaller in diameter than the adjacent portion of the coupler. The electrode 72 has a threaded coaxial bore 72*a* into which the extension 74*a* is threaded. The jacket 36*c*, which is electrically conductive, is cut slightly shorter than the insulator 36*b*, leaving a protruding sleeve of the insulator 36*b*. Insulator 36*b* is cut short to leave a protruding portion 36*d* of the conductor 36*a*. Tubular shaped insulator 78, preferably fiberglass or epoxy, extends completely around the perimeter of the lower end of the jacket 36*c*, the protruding end of the insulator 36*b*, any protruding portion of the conductor 36*a* which is exposed and the upper portion of the coupler 74. This construction prevents any direct short circuit between the lower end of the jacket 36*c* and the insulated conductor 36*a*, the coupler 74 or the electrode 72. The diameter of the jacket 36*c*, the insulator 78, the coupler 74 and the electrode 72 are all substantially the same, with the insulator 78 slightly, but not appreciably, larger since it extends around the exterior of the jacket 36*c* and the coupler 74. As a result the assembly depicted in FIG. 3, including the wire line, electrode and the insulator 78, provide a smooth surface to the flow of fluid, thereby reducing turbulence in flowing fluid and reducing wear on the receiver and facilitating insertion into the annulus. Preferably the outer diameter of the jacket on the wire line, the insulator 78 and the electrode 72 are all substantially ½ inch.

An optimum and preferred length for the electrode 72 is between 3 and 10 feet. The longer the electrode the better the contact between the conductive fluid and the electrode and hence the higher the signal to noise ratio of the received signal at the top of the well. However, the shorter the electrode the easier it will be to lower the electrode on the end of the wire down to the desired position in a narrow annulus.

The receiver shown in FIG. 4 may be employed in the system depicted in FIG. 1, 2 or 3. However, in FIG. 3 the resistance to the flow of current from the transmitter to the receiver must be low enough to provide a detectable potential on the electrode in the receiver. To this end it is desirable that the casing be electrically conductive, and that the lower portion of the tubing, such as tubular member 26*c*, be electrically conductive.

Figure 4A:
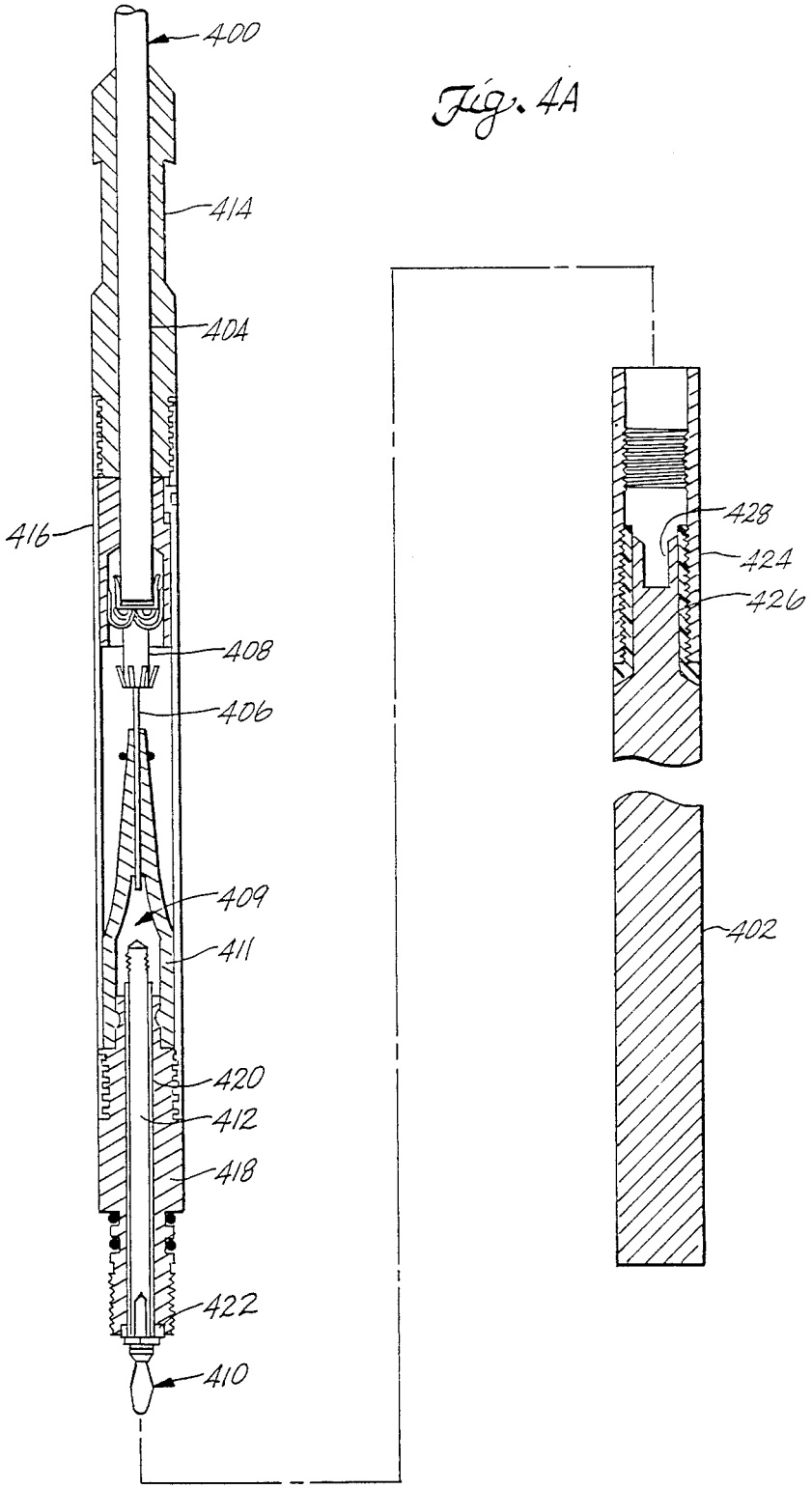
FIG. 4A is a cross-sectional and exploded view of an alternate receiver and make up to a wire line where the receiver is for receiving potentials from conductive fluid in the annulus.

FIG. 4A is a cross-sectional view of a receiver made up in a wire line where the receiver is of the type for receiving potentials from the conductive fluid in the annulus. A wire line 400 has an electrode type receiver 402, very similar to that disclosed with reference to FIG. 4, suspended at the end of the wire line. The wire line has an outer sheath 404, a central insulated conductor 406 and an annular insulator 408 separating the conductor 406 from the conductive sheath 404. The conductor 406 is connected to a spring contact or banana plug 410 by means of a terminal nut 409 having a circular bore into which the exposed end of the conductor 406 is inserted and crimped. The opposite end of the terminal nut 409 has a bore into which an end of contact rod 412 is threaded. The opposite end of the rod 412 has a threaded bore into which the rear end of banana plug 410 is threaded. The nut and electrically connected rod and plug, all being electrically conductive materials, provide continuous electrical path between the insulated conductor 406 and the plug 410. The conductive outer sheath 404 of the wire line is electrically connected in a babbit-type stinger 414 which in turn is threaded into one end of an electrically conductive sleeve 416. The opposite end of the sleeve 416 is threaded over the end of an electrically conductive contact sub 418, which in turn is electrically isolated from the rod 412 by an insulating sleeve 420 from plug 410 by an insulating washer 422.

Electrode 402 has its upper externally threaded end threaded into a sleeve-shaped coupler 424. An insulating sleeve 426 on the electrode 402 electrically insulates the electrode 402 from the coupler 424. The upper end of the electrode 402 contains a bore 428 into which the plug 410 is inserted. The upper end of the coupler 424 is constructed so that the coupler can be inserted over and threaded onto the lower end of the sub 418 until the plug 410 is in the bore 428 and in an electrical contact with the electrode 402. As a result, an electrical path is provided from the conductor 406 to the electrode 403 and the wire line sheath 404 is electrically insulated from the electrode. Thus the receiver is suspended mechanically from the sheath and is electrically connected to the insulated conductor.

Figure 5:
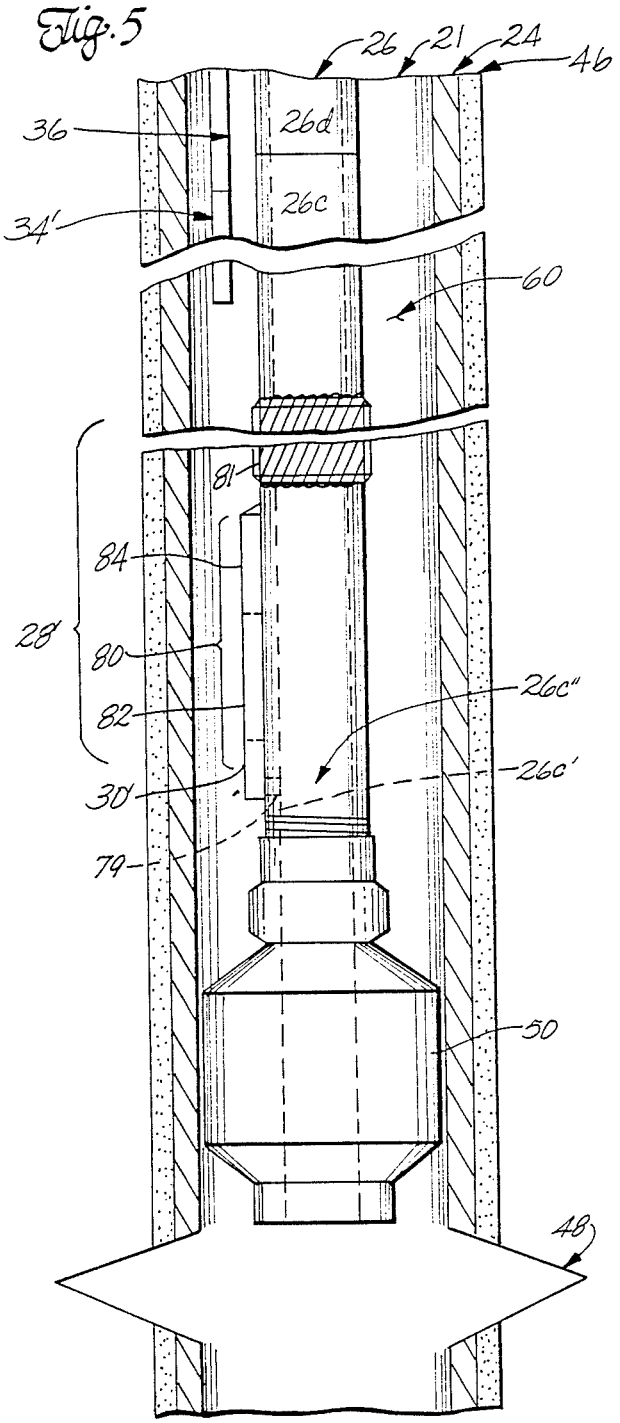
FIG. 5 is a schematic diagram of the lower portion of FIG. 2 depicting in more detail a transmitter mounted on the tubing string and a receiver for receiving potentials from conductive fluid in the annulus.

FIG. 5 depicts in more detail and more closely to scale a preferred embodiment of the present invention with a single electrode type receiver 34', and wire line of the type depicted in FIG. 4, together with a transmitter 28' and sensor 30' mounted on the string above the packer similar to that depicted in FIG. 2. FIG. 5 depicts the lower two annular members **26*d* and 26*c* of the tubing string 26, the electrically conductive casing 24, cement 46, annulus 21, the packer 50 and perforations 48, packer 50 is threaded on the lower end of the annular member 26*c*. Sensor 30' is of the pressure sensor type, and a passage 79 is tapped through the wall 26*c'* of the lower tubular member 26*c* to the central passage 26*c''* of the member 26*c*** to allow sensing of pressure in the central passage due, for example, to the fracturing fluid.

Transmitter 28' includes electronic section 80 and elongated coil 81 encircling and coaxial with the tubular member **26*c*. Electronic section 80 includes a battery section 82 for providing power to the sensor and a voltage to frequency convertor 84. The sensor 30' may be any one of a number of conventional sensors for sensing pressure and for providing an analog output signal proportional to the pressure sensed within the central passage of the tubing string (see discussion above). The voltage to frequency convertor 84 receives the analog signal and converts it to a frequency modulated signal which is proportional to the analog signal and applies the frequency modulated signal to the coil 81. The coil 81 in turn induces current to flow longitudinally in the wall 26*c'* of the tubular member 26*c*. Electrically conductive fluid 60 in the annulus 21 conducts the current to the electrode receiver 34' and as a result, a potential is formed on the electrode receiver 34'** relative to a reference. The reference in this embodiment of the invention may be the earth, the well casing, the tubing string, or the sheath on the outside of the wire line at the top of the well.

Figure 6:
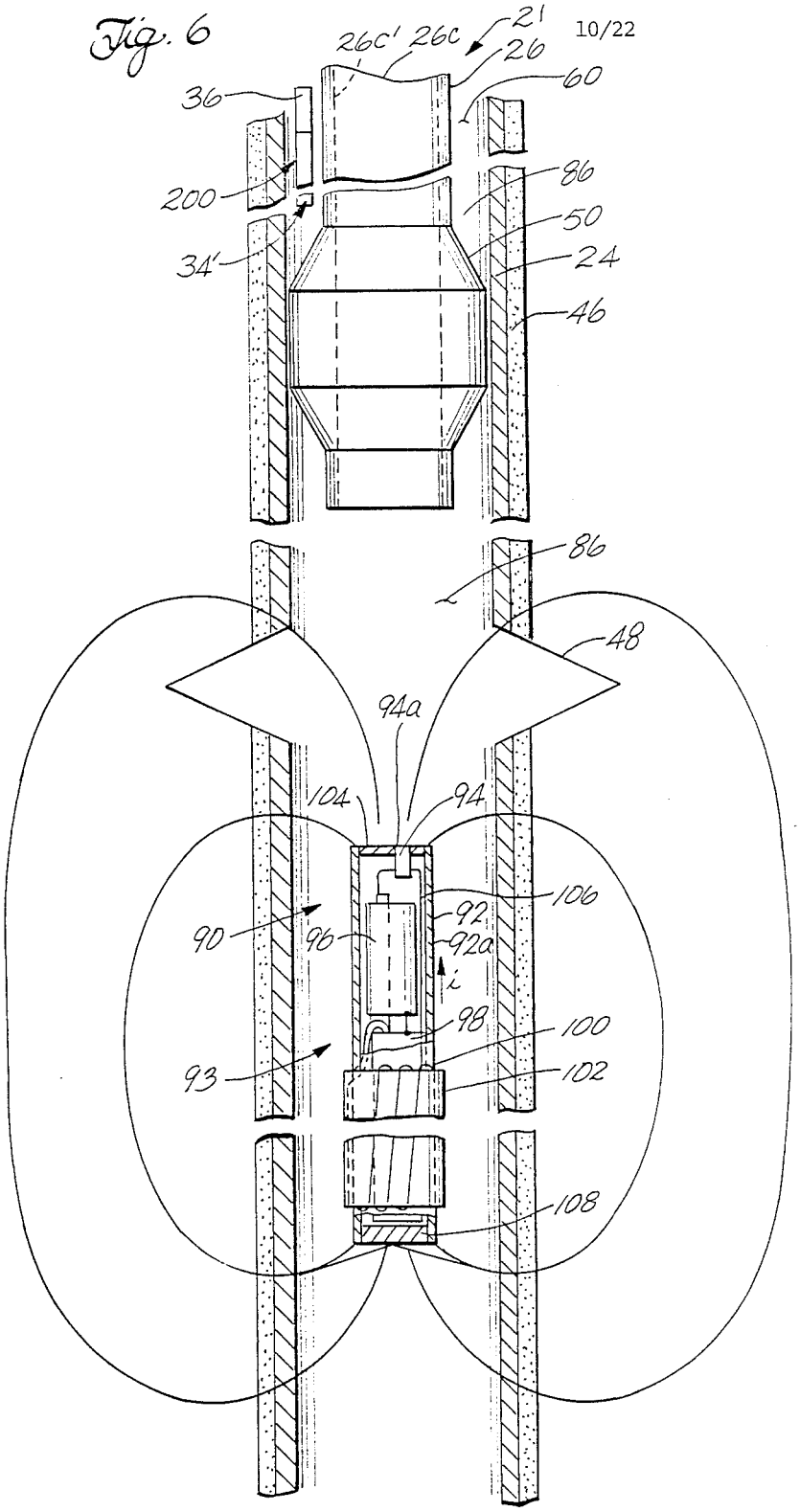
FIG. 6 depicts in more detail the lower portion of FIG. 3 in which the sensor and transmitter are mounted in a common module and passed down the central passage of the tubing string and an antenna for receiving potential differences from conductive fluid is positioned in the annulus.

FIG. 6 depicts in more detail the arrangement of FIG. 3 where the sensor and transmitter are dropped or "air mailed" down the central passage of the tubing string and packer to the bottom of the well bore. FIG. 6 again depicts in cross section the casing 24, cement 46, tubing string 26, and annulus 21 as well as conductive fluid 60, and the packer 50. Wire line 36 and single electrode receiver 34', similar to that described with reference to FIG. 4, are located in the annulus 21.

The transmitter is generally depicted at 90 and is in a single modular construction together with the sensor allowing the transmitter and sensor to be dropped down the central passage of the tubing string. More specifically, the module includes an elongated, preferably about 2 foot long, segment of tubing 92 containing therein pressure sensor 94, battery 96, voltage to frequency convertor 98 and an elongated coil 100. Preferably coil 100 is mounted on a tubular shaped ferrite core 102 and together are mounted on the outside of and coaxial with tubing 92. The windings of the coil 100 are wound longitudinally along the tubular core 102 and set up a longitudinally extending flow of current in tubing 92 as depicted at "i". The current induced in the tubing 92 flows longitudinally along the wall **92*a* of the tubing 92 into surrounding conductive fracturing fluid 86 through the wall 26*c'* of member 26*c* and through the casing 24 and hence through the conductive fluid 60 in annulus 21 to the electrode receiver 34' causing a potential to be induced on the electrode receiver 34' relative to a reference as discussed in connection with FIG. 5**.

Plugs 104 and 108, preferably made of electrically conductive material, are inserted in the opposite ends of the tubing 92 for sealing the inside of the tubing (and hence the sensor, the battery and the electronics) from the surrounding fluid. The sensor 94 has a passage **94*a* tapped through the plug 104 for sensing pressure external to the module. The coil 100 is insulated from the core and from the tubing 92 by insulation (not shown). Because of the alternating current frequency generated by the coil 100 circulating eddy currents may be set up in the tubing 99** as well as the longitudinal currents. However, the frequency of the signal is preferably sufficiently low that the eddy currents can be made small.

In some applications it will be desirable to insulate the length of the tubing 92 while using the electrically conductive plugs exposed in the ends of the tube, thereby causing the longitudinally extending induced currents to flow out of the plugs into the conductive fluid. This would minimize linkage current from the sides of the tubing 99.

Figure 7:
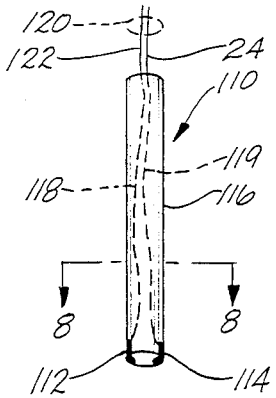
FIG. 7 is a schematic diagram depicting a dipole type receiver in which two horizontally displaced electrodes receive potential differences from conductive fluid in the annulus of FIGS. 1, 2 and 3.
Figure 8:
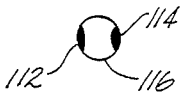
FIG. 8 is a cross-sectional view of the receiver of FIG. 7 taken along the line 8—8.

FIGS. 7 and 8 depict an alternate horizontal dipole type receiver for receiving potentials which has a pair of horizontally displaced exposed electrodes 112 and 114 connected by leads 118 and 119 to insulated conductors 122 and 124, respectfully on or in a wire line 120. The insulated conductors 122 and 124 and the wire line 120 extend to the top of the well. If a shielded wire line is used as in FIG. 4 one of conductors 122 and 124 may be connected to the shield and the other to the central conductor. The exposed electrodes 112 and 114 are recessed into or otherwise mounted on the bottom and partially up the side of a cylindrical rod 116 made of an insulating material. When the receiver of FIG. 7 is used in place of the receiver of FIG. 4 the signal created in the conductive fluid causes a potential difference between the horizontally spaced electrodes 112 and 114, which can be sensed at the top of the well between the conductors 122 and 124.

Figure 9:
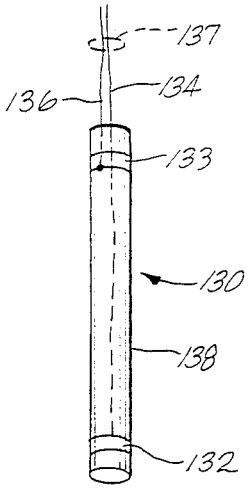
FIG. 9 is a schematic diagram of a vertical dipole receiver.

FIG. 9 depicts an alternate verticle dipole type receiver 130 which has vertically displaced electrodes 132 and 133 electrically connected, respectfully, to insulated conductors 134 and 136 in a wire line indicated at 137 which in turn extends to the top of the well similar to wire line 120 of FIG. 7. Electrodes 132 and 133 are ring shaped, recessed and mounted coaxially with and around the periphery of cylindrical rod 138, which is made of an insulating material.

The vertically displaced electrodes 132 and 133 and the horizontally displaced electrodes 112 and 114 of FIG. 7 are spaced sufficiently far apart to receive a potential difference on the spaced electrodes of a sufficient magnitude to be detected. The electrodes in both FIGS. 7 and 9 are recessed to protect the electrodes from physical contact with the tubing casing, fluids or other material as the receiver is passed down through the annulus and also to prevent a direct short between the electrodes due to the intervening conductive fluid. The larger the spacing between the electrodes the larger the signal will become between the electrode.

Figure 9A:
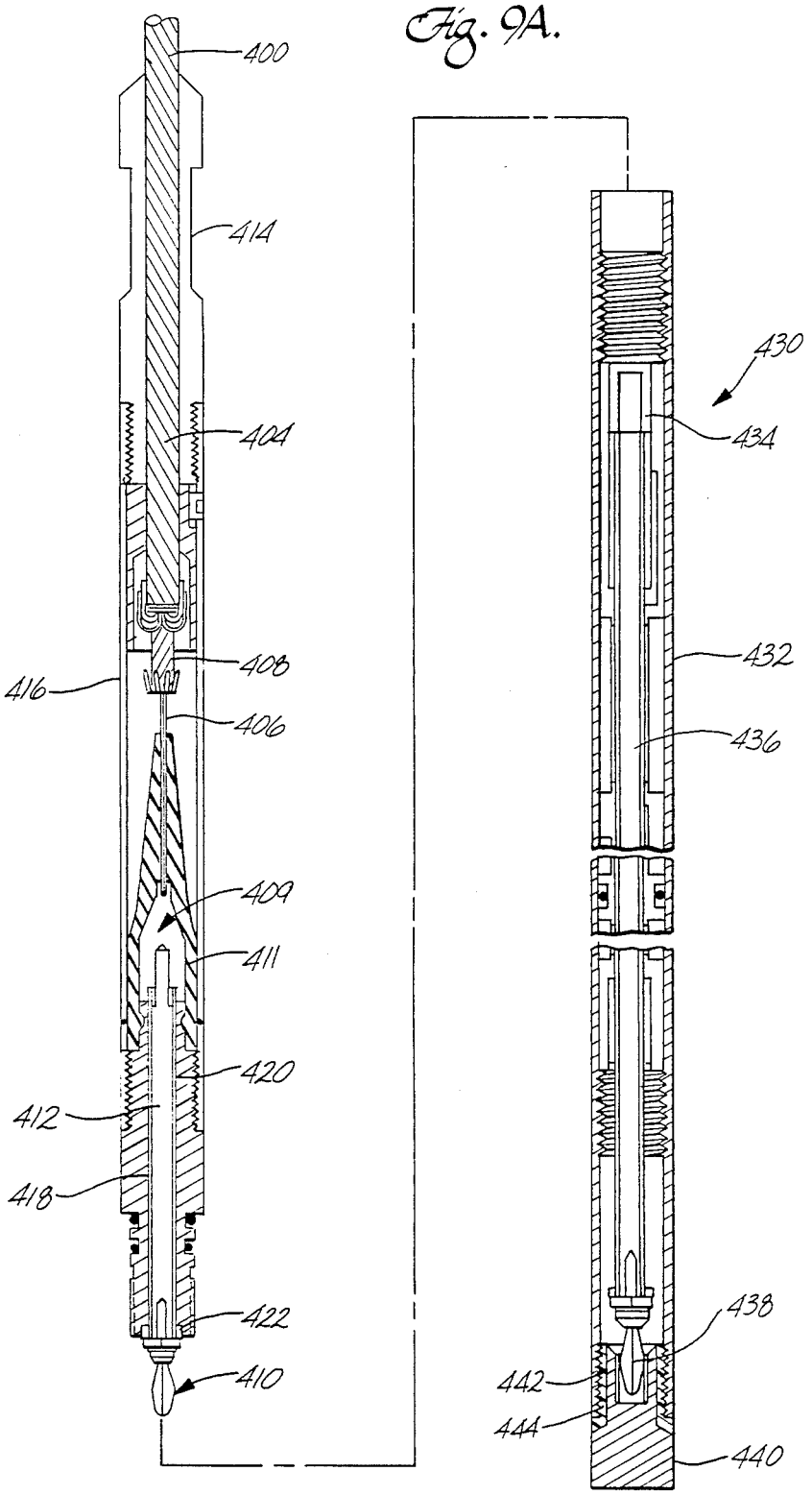
FIG. 9A is a schematic, cross-sectional and exploded view of a preferred vertical dipole receiver.

Refer now to the vertical dipole receiver of FIG. 9A. The wire line 400 and cable-head assembly are present and are identical to that described herein above with respect to FIG. 2A. The dipole assembly, which is connected to the end of the cable-head assembly, is depicted at 430 and includes a tubular member or sleeve 432 whose upper end is threaded onto the lower end of the cable head. A top receptacle 434 receives and forms an electrical contact with the plug 410 as discussed above. A contact rod 436 electrically connects the receptacle 434 to the threaded rear end of a spring contact plug 438, in a similar manner to the connection of plug 410 to rod 412. The upper electrode of the dipole is formed by the electrically conductive outer surface of the sleeve 416. The lower electrode is formed by an electrically conductive plug 440 which has a cylindrical outer surface exposed for electrical contact with the surrounding fluid. The outer surfaces of both the sleeve 416 and the plug are copper plated to enhance conductivity. If needed, the sleeve 432 can be either made of a non-conductive material or of a conductive material, but with a nonconductivity epoxy coating covering the outside, so as to electrically insulate the same from the conductive fluid. The plug 440 is threaded into the lower end of sleeve 432. A non-conductive sleeve 444 on plug 440 electrically isolates the plug 440 from the sleeve 432. The sleeve 432 is electrically insulated by insulators from the receptacle 434, rod 436 and plug 438 as generally indicated in FIG. 9A. The sleeve 432 may either be made of a non-conductive material or of a conductive material, but with a non-conductive epoxy coating covering the outside, so as to electrically insulate the same from the conductive fluid.

Figure 10:
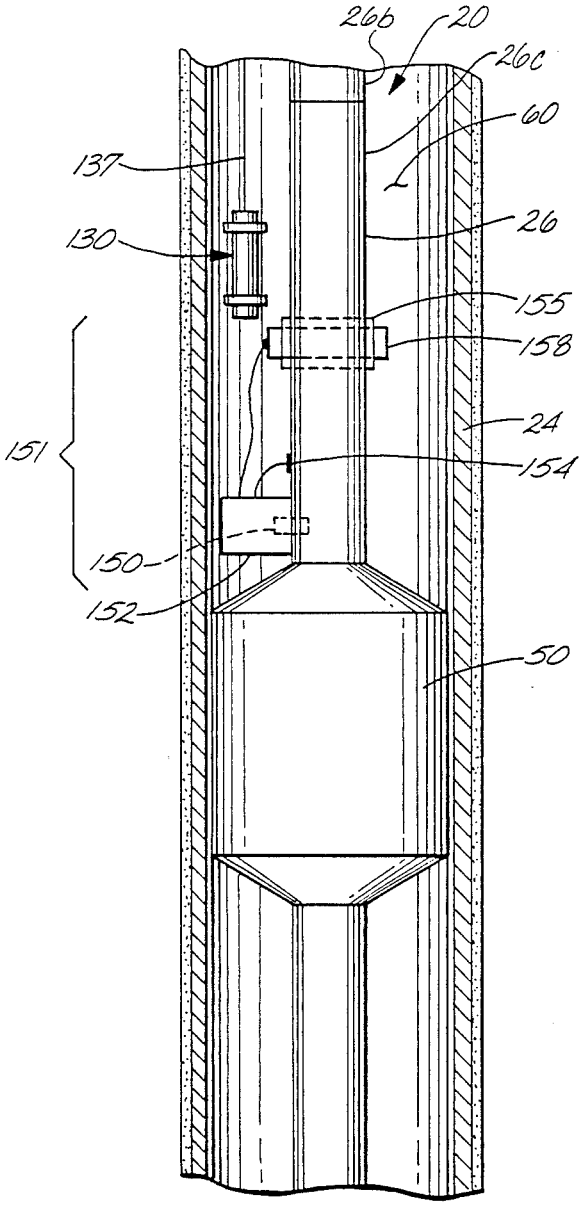
FIG. 10 depicts the details of one arrangement for the lower portion of FIG. 2 in which the sensor and transmitter are mounted on the tubing string above the packer and the receiver receives potentials from conductive fluid in the annulus.

FIG. 10 depicts an alternate transmitter 151 for use with the receiver 130 and wire line 137 of FIG. 9 or that of FIG. 9A. As in FIG. 5, FIG. 10 shows tubing string 26, casing 24, cement 46, and packer 50 and a sensor 150 whose sensing input is tapped through the wall of the tubular member 26c to the inside passage of the tubing string. The transmitter includes a battery and electronics unit 152 similar to 82 and 84 of FIG. 5, which are mounted on member 26c and converts the analog signal representing pressure from the sensor to a frequency signal the outputs of which are applied between an electrode 154 on electrically conductive tubing member 26 and electrode 158. Electrode 158 is a conductive copper ring which is mechanically mounted on and coaxially around the member 26c. Ring electrode 159 is electrically insulated from member 26c by a non-conductive ring shaped sleeve 155. With this arrangement the signals provided by the transmitter 151 are applied between electrodes 154 and 158 which in turn causes electrical current to flow in the member 26c along the member 26c which in turn causes current to flow in the electrically conductive fluid 60 which in turn causes a potential difference between the electrodes 142 and 144. It should be noted, however, that the spacing between electrodes 154 and 158 should be sufficient to produce the required potential difference between the electrodes 142 and 144. Preferably the receiver is positioned close by and preferably in between electrodes 154 and 158 so as to maximize the potential difference between electrodes 142 and 144.

Figure 11:
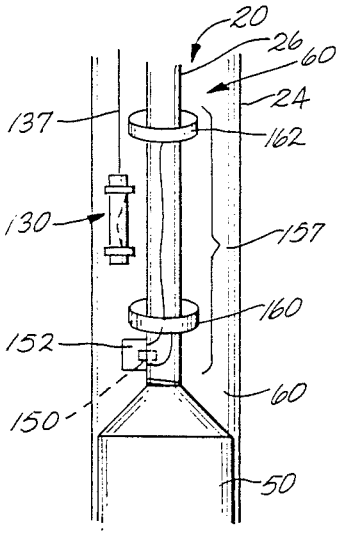
FIG. 11 is a schematic diagram of the lower portion of a system similar to that depicted in FIG. 2 in which the sensor and transmitter are mounted on the lower portion of the tubing string above the packer and a receiver for receiving potentials from conductive fluid is located in the annulus.

FIG. 11 depicts a tubing string 26 within a conductive metal casing 24 having a packer 50 connected at the lower end, all similar to that discussed above with respect to FIG. 10. Mounted on the tubing string is a transmitter 157 which includes battery and electronics unit 152, and a sensor 150 all similar to that of FIG. 10. The output from the electronics unit 152, between which signals are formed, with a frequency representing the sensed pressure, are applied between vertically displaced electrically conductive rings 160 and 162 in the transmitter. The rings 160 and 162 similar to the ring electrode 158 of FIG. 10, are electrically insulated by means (not shown) from and are mounted coaxially about and on the tubing string 26. A receiver 130 similar to that disclosed in FIG. 9 is positioned between the spaced apart ring electrodes 160 and 162. With this arrangement where the receiver 130 is positioned between the ring electrodes 160 and 162 the potential difference on the receiver electrodes will be greater and therefore easier to detect than in the embodiment depicted in FIG. 10.

Figure 12:
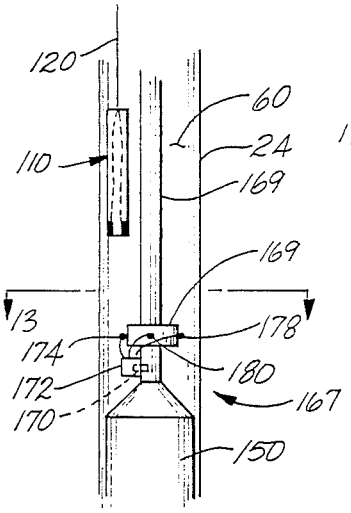
FIG. 12 is a schematic and cross-sectional view similar to FIG. 11 depicting an alternate arrangement in which the receiver receives potentials from conductive fluid in the annulus.
Figure 13:
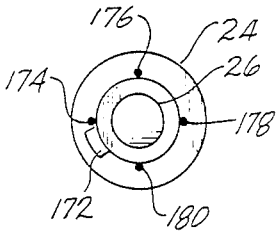
FIG. 13 is a cross-sectional view takan along the lines 1313 of FIG. 12.

FIGS. 12 and 13 depict a receiver 110 suspended from the end of a wire line 120, similar to that disclosed in FIG. 7, in annulus 21 between a tubing string 26 and conductive metal casing 24. A packer 50 is at the lower end of the tubing string. Transmitter 167 includes a non-conductive ring 169 coaxial with and mounted on the tubing string 26. Electrodes 174, 176, 178 and 180 are equally spaced at 90° with respect to each other and are mounted on the periphery of the ring 169. The transmitter 167 also includes electronics and battery unit 172. The unit 172 and a sensor 170, which is tapped through the wall of the tubing 26 to sense pressure in the central passage are mounted on the tubing string 26. The unit 172 converts the analog signal from pressure sensor 170 to a frequency signal and then applies the signal for the electrodes. The signal on each electrode is 90° out of phase with respect to the signal applied to the adjacent electrode and 180° out of phase with the electrode on the diametrically opposite side of the ring 169. With this arrangement the receiver 110 will be less sensitive to the relative orientation between the receiver and the electrodes in the transmitter.

Figure 14:
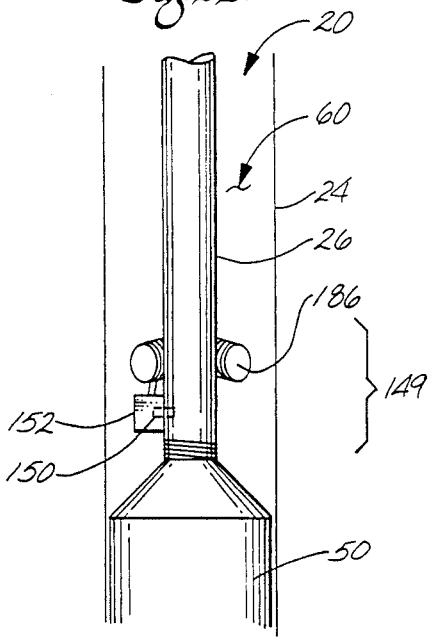
FIG. 14 is a schematic and cross-sectional view depicting the lower end of a tubing string, a packer with a sensor and transmitter mounted on the tubing string above the packer, disclosing a specific form of the transmitter.

FIG. 14 depicts an alternate transmitter 149 including an electronics and battery unit 152, and a sensor 150 similar to that disclosed with reference to FIG. 11 but adapted for providing a frequency signal corresponding to the sensed pressure to a donut shaped coil on a core as depicted at 186. The coil 186 on the core are mounted coaxially around one of the tubular members of the tubing string 26. Energization of the coil causes current to flow longitudinally in the conductive tubing string 26 which in turn sets up potentials in surrounding conductive fluid which in turn will be picked up by a receiver in the annulus as discussed above. Preferably the receiver (not shown) is one with vertically displaced exposed electrodes similar to that discussed with reference to FIG. 9.

Figure 15:
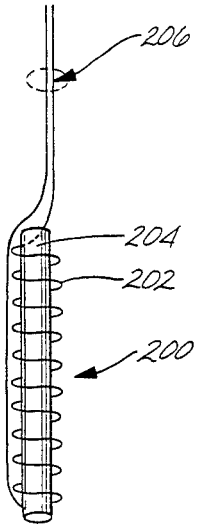
FIG. 15 is a schematic diagram and depicts an alternate receiver for use in the annulus and which receives electromagnetic fields.

FIG. 15 depicts an alternate arrangement in which the receiver is of a solenoid-type which picks up magnetic fields produced by the transmitter. The receiver 200 is in the form of a coil spirally wound around a cylindrical ferrite core 204. The ends of the coil 202 are connected between the central conductor and the conducting metal sheath on a wire line 206 (similar to that discussed in FIG. 4), which extends to the top of the well. Preferably the receiver is housed in a non-magnetic housing (not shown) the diameter of the antenna is preferably approximately the same as or smaller than the diameter of the wire line 206.

Figure 15A:
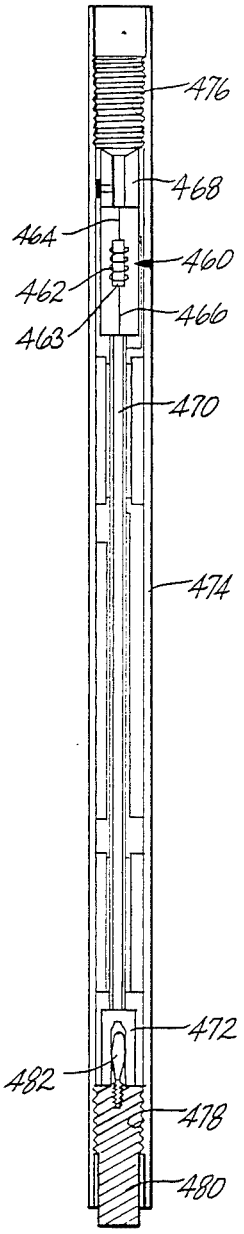
FIG. 15A is a schematic, cross-sectional and exploded view of a preferred receiver for receiving electromagnetic fields.

FIG. 15A depicts a preferred construction for the inductive type or solenoid type receiver for mounting at the end of a wire line and cable-head assembly such as that depicted in FIG. 2A. The receiver coil assembly is depicted at 460 and includes a coil 462, wound about a core 463. The coil has ends 464 and 466 which are connected, respectfully, to an electrically conductive receptacle 468 and a contact rod 470. The receptacle 468 is constructed for receiving and electrically forming a connection with the plug 410 of the cable head. The opposite end of the rod 470 from the end 466 is electrically connected to another receptacle 472. The assembly also includes an outer electrically conductive sleeve 474, having upper threaded end 476 into which threads on the lower end of the sub 418 of the cable head is inserted and forms an electrical connection. Also plug 410 of the cable head is inserted into and forms an electrical contact with receptacle 468. The sleeve 474 also has a lower threaded end 478 into which a plug 480 is threaded. The plug 480 has a spring-type plug 482 which is inserted into and forms electrical contact with the receptacle 472. The plug 480 is an electrically conductive material which electrically connects the receptical 472 and hence the rod 470 and end 466 of the coil 462 to the outer electrically conductive sleeve 474, which in turn is electrically connected to the electrically conductive sub, and therefore to the electrically conductive outer sheath of the wire line 400. The other end 464 of the coil 462 is electrically connected through the receptacle 468 to the plug 410 and hence to the conductor 406 of the wire line. As a result the magnetic signals received by the coil, cause electrical signals to be applied between the ends 464 and 466 of the coil, which in turn may be sensed at the top of the well between the center conductor and outer sheath of the wire line.

Figure 16:
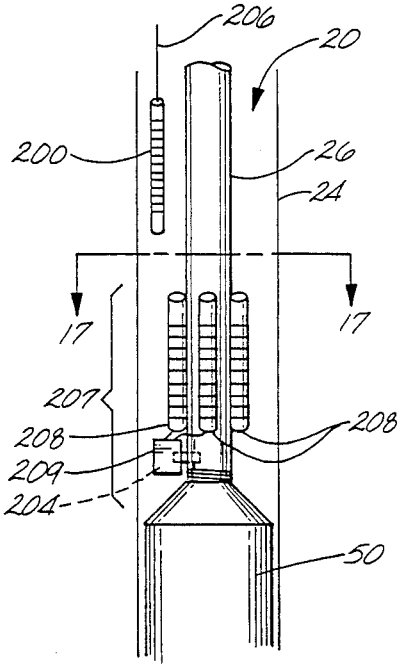
FIG. 16 is a schematic and cross-sectional view of the lower portion of the system of FIG. 2 depicting a sensor and transmitter mounted on the lower portion of the tubing string above the packer and a receiver in the annulus where the transmitter forms magnetic fields in the annulus and the receiver receives the magnetic fields.
Figure 17:
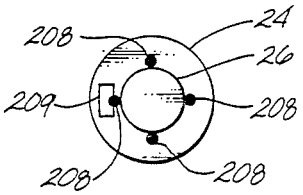
FIG. 17 is a cross-sectional view taken along the line 1717 of FIG. 16.

FIG. 16 depicts the receivers of FIG. 15 or 15A located in the annulus 20. Systems which have magnetic transmitters and receivers and do not require conductive fluid in the annulus will now be described. Forming a transmitter 207 and mounted on the tubing string 26, are a plurality of four solenoid transmitting antennas 208 and an electronics and battery unit 209. The antennas are elongated longitudinally along the axis of the tubing string 26 and are positioned in a circle 90° apart from the adjacent ones. It should be understood that more or less transmitting antennas may be used if desired, depending on the configuration of the well and the receiver. With this arrangment unit 209 converts the analog signals representing pressure formed by a sensor 204 to a frequency signal and applies the frequency signal to the transmitting antennas 208 which in turn radiate data signals in the form of magnetic fields to the receiver 200. The receiver 200 picks up the data signals and data signals representing the pressure parameter are conducted over the wire line 206 to the top of the well.

Figure 18:
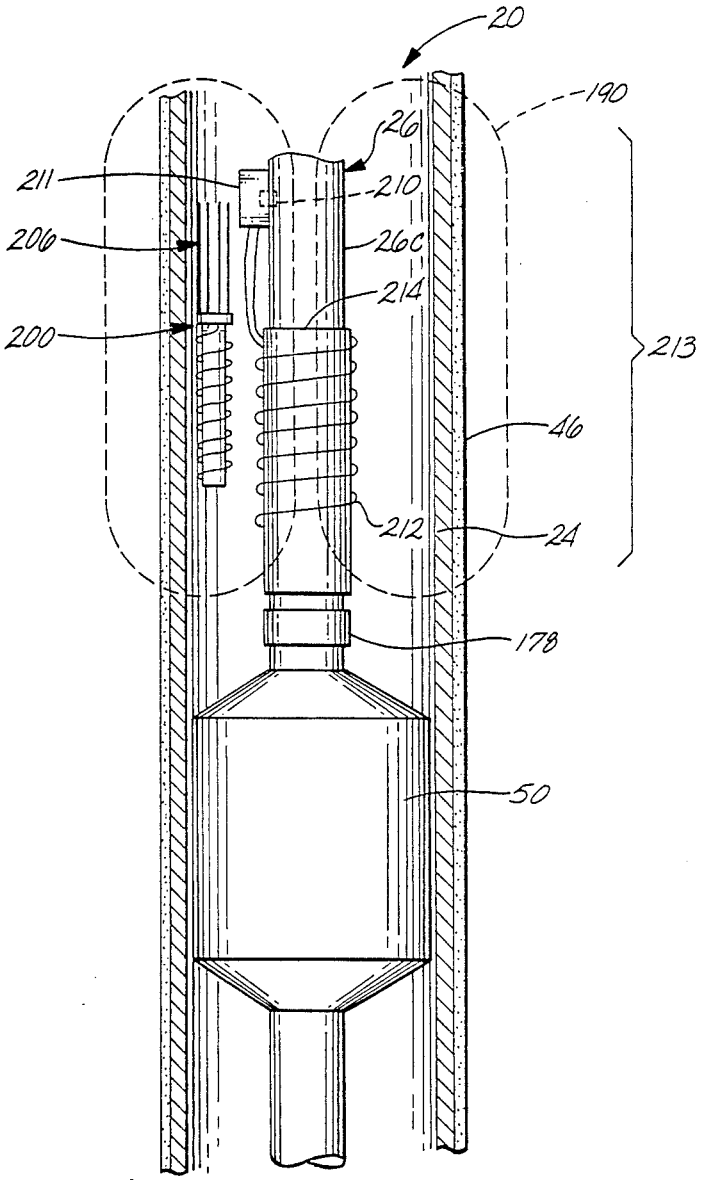
FIG. 18 is a schematic and cross-sectional view taken at the lower portion of FIG. 2 depicting an alternate sensor and transmitter mounted on the tubing string above the packer and a receiver in the annulus in which magnetic fields are formed by the transmitter and received by the receiver.

FIG. 18 depicts an alternate arrangement of a magnetic transmitter and receiver. With this arrangement receiver 200 and wire line 206 as described with reference to FIG. 15 are positioned down the annulus 21.

The transmitter 213 includes a ring shaped coil 212 which is mounted on and coaxially around tubular member **26*c* of the tubing string 26. An annular shaped insulated sleeve 214 separates the tubing member 26*c* from the coil 212. The transmitter also includes a sensor 210 mounted on and tapped through the wall of the tubing string member 26*c* for sensing the central passage pressure. Electronics and battery unit 211 both mounted on the tubing member 26*c*. The electronics and battery unit 211 converts the analog signals from the pressure sensor 210 to frequency signals which are then applied across the ends of the coil 212 causing magnetic fields to be radiated out and received by the receiver 200. With this arrangement the receiver 200 can be placed ajacent to and between the coil 212 and the casing 24 to maximize the pickup by the receiver. This arrangement provides an efficient way of mounting the sensor and transmitter on one of the tubing members of the tubing string without requiring any modification of the packer 50**.

Figure 19:
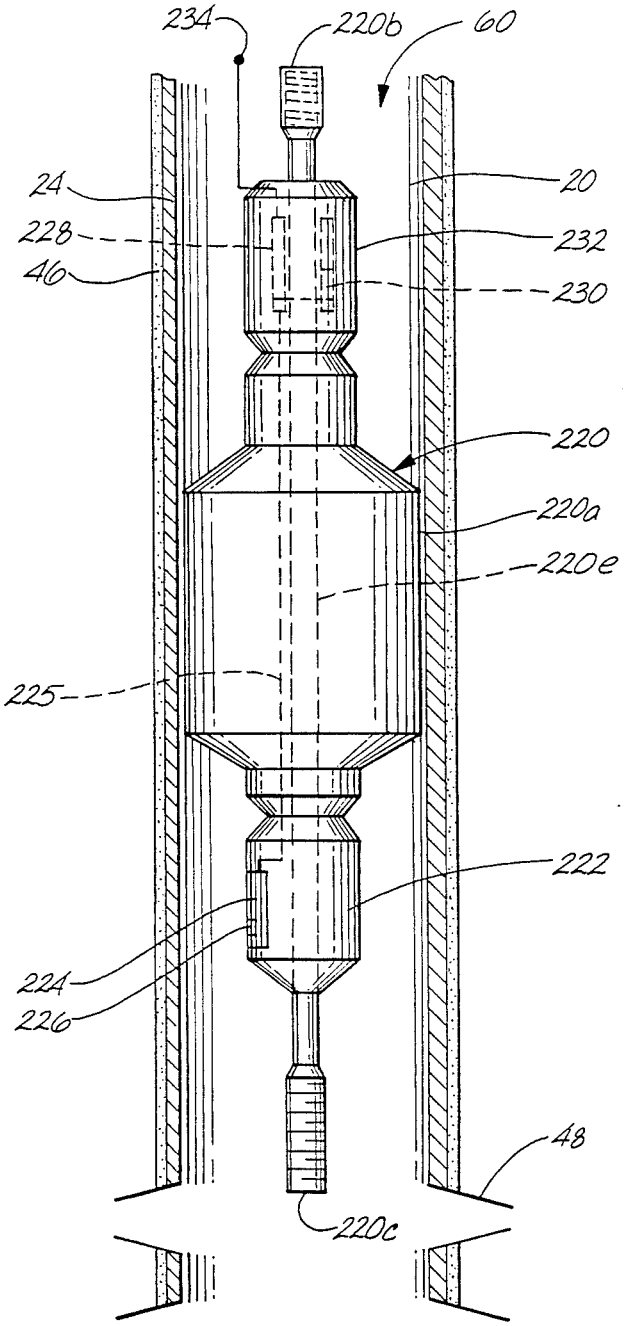
FIG. 19 is a schematic and cross-sectional view depicting the actual construction of the mounting for a sensor and transmitter formed on a modified packer for sending and receiving magnetic fields.

FIG. 19 depicts an alternate sensor and transmitter connected to a packer 220. Packer 220 is in the central passage of casing 24 which is cemented by cement 46 into a well bore hole with perforations 48 through the casing and cement to the adjacent formations similar to that depicted in FIGS. 1–3. Packer 220 is a conventional packer well known in the art having an upper threaded receptacle **220*b* for receiving the lower threaded end of a tubular member in the tubular string and a lower threaded connector 220*c* for mating with a receptacle in a lower tubular member or other tool. The packer 220 has a radially inflatable mid-section 220*a* and a passage 220*e* passes from the upper end 220*b* through the central passage to the lower end 220*c*. The packer is constructed, as is well known in the oil drilling art, for radially inflating at the mid-section 220*a*** when pressure is applied in the central passage to expand the packer into ceiling engagement with the inside wall of the casing.

Lower housing 222 is mounted at the lower side of the mid-section **220*a* and has mounted therein pressure sensor 224 having a port 226 to the annulus between the housing 222 and the casing through which the sensor senses annulus pressure. The sensor 224 is connected by conductors 225 to an electronics unit 228 located in an upper housing 232 positioned at the upper side of the inflatable midsection 220*a*. The upper housing 232 also has power supply batteries 230 mounted therein for powering the electronics and if necessary the sensor. An antenna 234 is electrically connected to the electronics 228 and extends from the upper housing portion 232 as schematically depicted. The antenna 234** may be any one of several types, but preferably is of the solenoid type as discussed above in connection with FIG. 15.

In operation the packer is connected to an upper tubular member in the tubing string and is lowered down the central passage of the casing 24 to the desired location, preferably immediately adjacent and above perforations in the casing and cement through which fracturing of fluid is to be passed for fracturing and adjacent formation. When the tubing string with the packer is at the desired location, fluid is pumped down the central passage of the tubing string into the central passage 220e of the packer causing the packer to radially inflate and seal around the inside wall of the casing 24. Fracturing fluid is then passed down through the central passage of the tubing string entering the central passage 220e and passing out the lower end 220c to the perforations and into the adjacent formation. The sensor 224 senses the pressure in the annulus around the housing 222 and the electronics unit 228 converts the analog signal from the sensor to a frequency signal which is then radiated by antenna 234 to a receiver (not shown) located in the annulus around the tubing above the packer as described in and above.

With this configuration the sensor electronics power supply and antenna are all carried with the packer and are positioned via the tubing string at the desired location where pressure is to be sensed. The advantage to this configuration is that no additional tools are required. Advantage of locating the sensor electronics power supply and antenna on a separate tubular member in the tubing string, such as that depicted in FIG. 18, is that the sensor and transmitter can be made up on or in a tubular member of the tubing string without modificiation to the packer.

Figure 20:
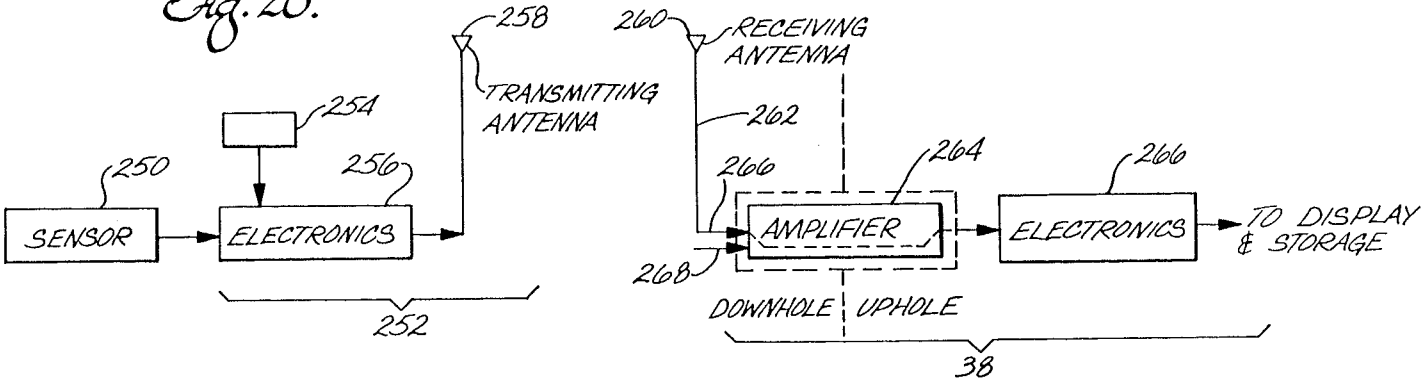
FIG. 20 is a schematic diagram of a sensor, transmitter, receiver and processing display and storage for use in the system of FIGS. 1, 2 and 3.

Refer now to FIG. 20 which depicts a schematic diagram of over all systems involved in detecting, providing and sending data signals representing a parameter from down hole to the top of the well bore. Sensor 250 senses the parameter, preferably pressure, and provides a data signal to transmitter 252. The transmitter 252 includes electronics 256 and a signal sender for sending signals into the annulus between the tubing string and the casing. The signal sender is generally referred to herein for ease of reference as transmitting antenna 258 and includes either apparatus for inducing potentials in the conductive fluid in the annulus or the solenoid type antenna which generates electromagnetic fields in the annulus. Also included is a battery 254 for providing power to the electronics 256 and if necessary to the sensor 250. To be explained in more detail the electronics 256 may take on a number of configurations, however, it is arranged for receiving data signals from the sensor 250 representing the sensed parameter and for producing data signals which can be sent by the transmitting antenna 258 to and received by a receiver. The sensor 250, transmitter 252 and battery 254 are always located down hole. A receiver, also referred to for convenience, as a receiving antenna 260, receives the data signals representative of the parameter which has been sent into the annulus by the transmitting antenna 258. In one embodiment a wire line 262 (with one or multiple conductors), conduct data signals representative of the parameter (represented by the received data signals) up hole to receiving electronics, display and storage apparatus 38 (see FIG. 1). Apparatus 38 includes amplifier 264 which amplifies the data signals from the wire line and receiving input 266, which processes the amplified signals into a form suitable for display and/or storage by means not shown in FIG. 20.

To be explained in the more detail the amplifier 264 may be divided up into two amplifier sections, a preamplifier section down hole at the lower end of the wire line near the receiving antenna 260 and an amplifier section up hole. The preamplifier section preamplifes the signals before they are conducted by the wire line up hole to the rest of the amplifier section. If the signal is preamplified before conduction up the wire line, the wire line must be a coaxial conductor, by way of example as shown in FIG. 4. Also, power can be provided over the wire line from the top of the wire line without adding additional conductors thus avoiding the need for batteries or other sources of power down at the receiver. It should also be noted that the amplifier will have two inputs indicated at 266 and 268. The input 266 may be connected to the insulated conductor in the wire line whereas the other input 268 may be connected to a shield (if present) or other conductor in or on the wire line, the upper end of the casing 24 at the top of the well or to one or more ground electrodes positioned in the ground around the well, depending on the configuration and design of the system. Where the receiving antenna receives potentials, the shield or other conductor of the wire line, the upper end of the casing or the ground electrodes connected to the second input 268 become a source of reference potentials or a reference with respect to which the signals at input 266 are detected. In the arrangement where the receiving antenna 260 is a magnetic pick-up, picking up magnetic signals, the inputs 266 and 268 will be effectively connected across the ends of the coil forming a part of the magnetic pick-up in the receiving antenna.

With the foregoing in mind it will be appreciated that if all sections of the amplifier 264 are contained at the top of the well, then the receiving antenna and everything at the bottom of the wire line will be passive and thus will minimize the amount of the electronics, the power required down hole and the outer size of the equipment lowered on the end of the wire line. If on the other hand portions of the amplifier or other electronics are located down hole at the lower end of the wire line, then the equipment at the receiving antenna is not passive and may require additional and larger equipment then with a passive arrangement.

Figure 21:
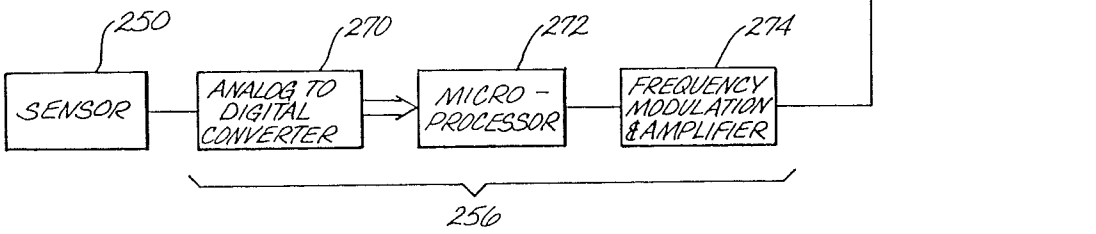
FIG. 21 is a schematic and block diagram depicting the sensor and details of a transmitter for forming digitally encoded frequency modulated carrier signals representing the parameter.

FIG. 21 shows a specific example of the electronics 256. Specifically the sensor provides an analog output whose amplitude is proportional to sensed pressure. Analog to digital convertor 270 converts the analog signal to digital coded signals for a micro-processor 272. The micro-processor 272 converts the digital signals into a serial and redundantly encoded bit string. The frequency modulation and amplifier unit 274 then transmits the serial bit string via transmitting antenna 258 into the annulus using a signal of one frequency to represent a binary 0 and a signal of a second frequency to represent a binary 1. The data signal is then sent by the transmitting antenna 258 into the annulus.

It should be understood that the frequency modulator 274 may be replaced by other suitable means for forming signals that may be sent out into the annulus by antenna 258, such as circuits which produce amplitude modulated signals, phase modulated signals or other suitable signals for transmission by transmitting antenna 258.

The analog-to-digital convertor 270 may comprise any one of a number of convertors well known in the art as may processor 272. Preferably the processor is a CMOS circuit and encodes the signals provided to frequency modulator 274 to a form which allows error correction. Preferably the microprocessor 272 provides digital signals to the frequency modular 274 at the rate of 1 binary bit per second. A suitable carrier frequency is preferably as low as 10 to 20 hertz and as high as 10 kilohertz or higher.

Figure 22:
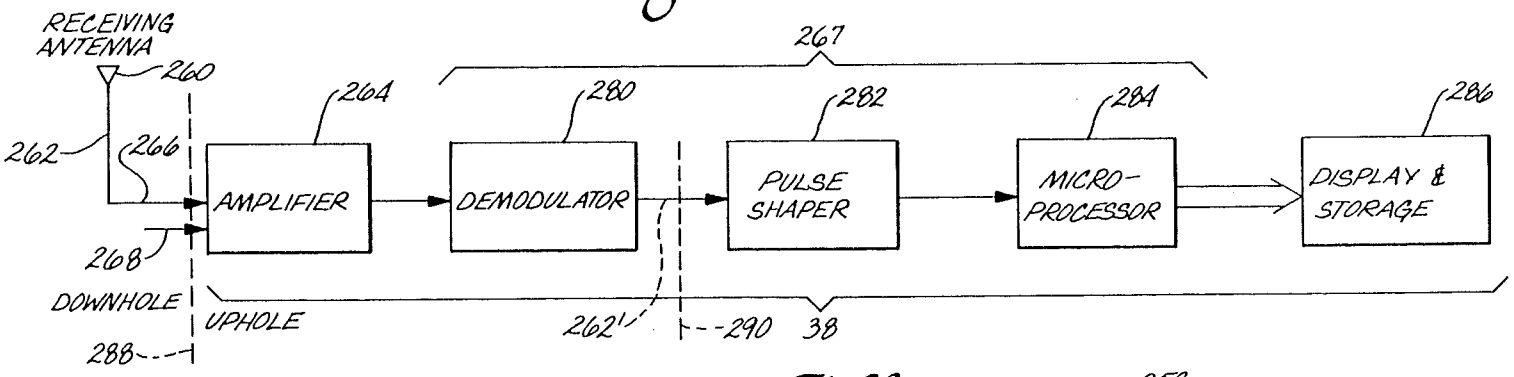
FIG. 22 provides a schematic and block diagram depicting the details of the processing display and storage for frequency modulated carrier signals received by the receiver of FIG. 20.

FIG. 22 depicts a specific embodiment of the receiving portion of FIG. 20 including the receiving antenna 260 and the receiving electronics, display and storage apparatus 38. Apparatus 38 includes amplifier 264, electronics 267, and a display and storage unit 286. The system of FIG. 22 is for receiving data signals represented by the frequency modulated signals produced by the system of FIG. 21. Specifically, receiving antenna 260 receives the frequency modulated data signals from the antenna 258 of FIG. 21. With a passive system the signals are conducted directly from the antenna 260 up the wire line 262 to amplifier 264 where the data signals are amplified. The demodulator 280 converts the amplified data signals from frequency modulated signals to digital signals representative of the parameter. Pulse-shaper 282 shapes the signals into a proper form for reading by micro-processor 284. Micro-processor 284 processes the digital signals into the proper form for display such as on a digital visual display and for storage such as on magnetic tape, disk or the like.

The system of FIG. 22 just discussed is passive, that is, none of the amplifier or other electronics, are located at the bottom of the wire line.

In another arrangement the amplifier 264 and demodulator 280 are located down hole at the receiving antenna as depicted to the left of dash line 290 and the pulse-shaper, microprocessor in display and storage are located up hole as indicated to the right of dash line 290. With this latter arrangement, wire line 262 would be replaced by a suitable electrical connector to amplifier 264 and the wire line would be positioned at 262' between the demodulator and the pulse-shaper. With this arrangement the signals will be of higher amplitude and therefore easier to detect at the top of the hole than if no amplifying is provided down hole.

Figure 23:
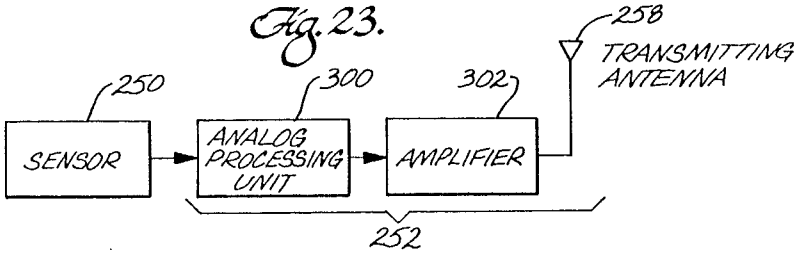
FIG. 23 is a schematic and block diagram depicting an alternate arrangement of the sensor and transmitter in which analog signals from the sensor are converted to frequency modulated signals for sending to the receiver.

FIG. 23 depicts a specific embodiment of the sensor electronics and transmitting antenna 258 shown to the left in FIG. 20 where the pressure parameter data signals are encoded in analog form. The analog output data signals from the sensor 250 representing the pressure parameter are processed by the analog processing unit 300 and converted to a frequency modulated signal, the frequency of which represents the analog signal and hence parameter. The frequency modulated signal is then amplified by amplifier 302 and then sent to the transmitting antenna 258 for sending data signals into the annulus for pick-up by the receiving antenna. The analog processing unit 300, by way of example operates on an analog signal from 0–5 volts and converts these signals to a frequency from 10–several thousand hertz, the actual frequency being proportional to the actual voltage level of the analog signal. Preferably the analog processing unit 300 alternates between the frequency representing the actual analog signal and a signal representing the full scale analog output for calibration purposes at the top of the well.

Figure 24:
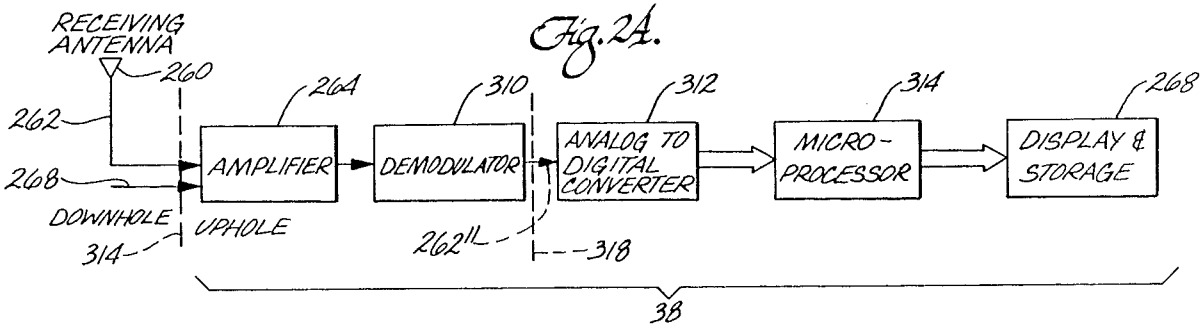
FIG. 24 depicts a receiver and processing, display and storage apparatus for use with the data signals provided by FIG. 23.

FIG. 24 depicts the receiving antenna 260 and the receiving electronics and display and storage apparatus 38 for use with the data signals formed by the transmitter of FIG. 23. Specifically, the data signals sent by antenna 258 of FIG. 23 are received by receiving antenna 260, signals corresponding thereto representing the sensed parameter are conducted up the wire line 262 to amplifier 264 which amplifies the signals and provides them to demodulator 310. Demodulator 310 converts the frequency modulated signals back to analog voltage signals in the range of between 0–5 volts, the magnitude of which represents the value of the parameter. Analog to digital convertor 312 converts the analog signals to digital form for the micro-processor 314. The micro-processor 314 does signal processing to remove errors from the signal and to convert the digital signals to a form which can be displayed and stored by display and storage unit 268 in the manner discussed above.

With the arrangement just discussed, the down hole portion of the system at the receiving antenna 260 is passive. To this end the dashed line 318 indicates that everything to the left is down hole whereas everything to the right is up hole. It may be desirable in some applications to locate the amplifier and demodulator down hole at the receiving antenna 260, in which case the portion to the left of dash line 318 will be down hole and the portion to the right will be up hole and the wire line will be at 262" between the demodulator and the analog to digital convertor.

The digital system depicted in FIGS. 21 and 22 are potentially more accurate than the analog versions of FIGS. 23 and 24, since in the digital version error correcting encoding methods can be used to correct for the effects of noise in the transmission link.

The analog version depicted in FIGS. 23 and 24 has an advantage in that less down hole electronics are generally required in order to conduct the signals to the top of the well, making it easier to design for high temperatures. Additionally, less power is required down hole.

Figure 25:
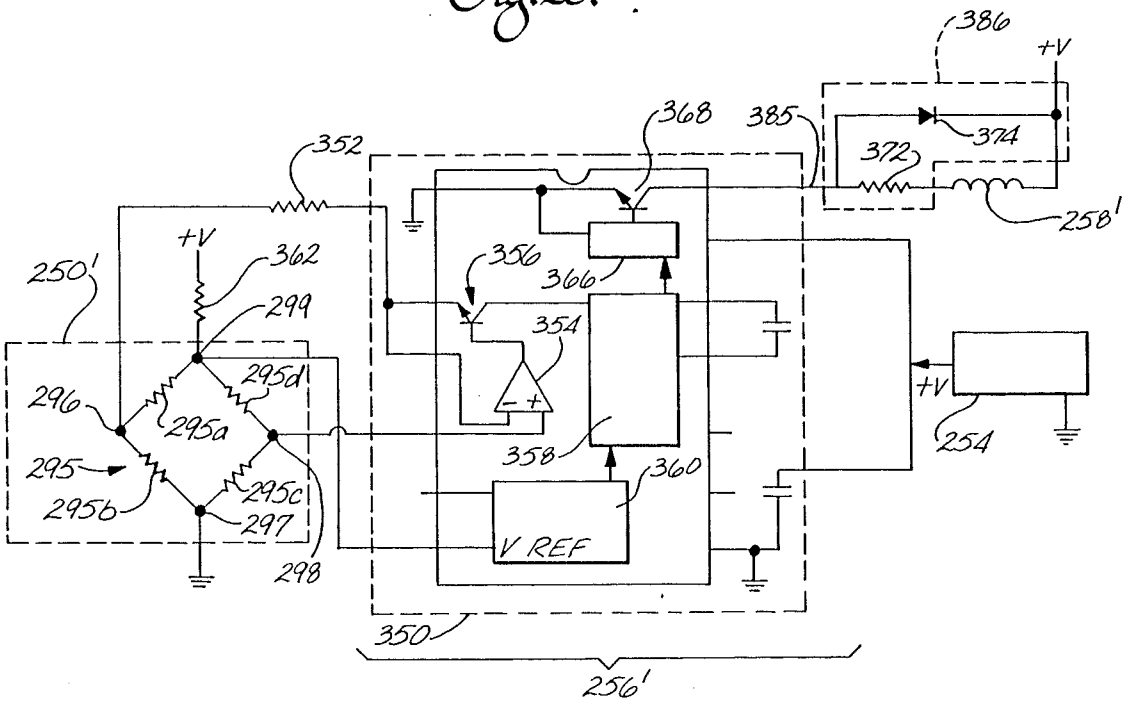
FIG. 25 is a detailed schematic diagram of the sensor and transmitter for forming electromagnetic fields for use in FIG. 20.

FIG. 25 depicts a specific example of the sensor, electronics and transmitting antenna of FIG. 20 which produces magnetic fields and electrical potentials in the annulus. Although the circuit of FIG. 25 forms electrical potentials in the conductive fluid for the electrode receiver, it is preferrably used to form magnetic signals for inductive type receivers where there is a close spacing between the transmitting antenna and the receiver.

Sensor 250' includes a balanced bridge circuit 295 having a conventional four terminal bridge with resistors 295*a*, 295*b*, 295*c*, and 295*d*, each connected between a different pair of terminals. Terminal 297 is connected to the ground conductor for power supply or battery 254. Terminal 299 is connected through resistor 362 to the +V side of battery 254. Pressure sensitive resistor 295*a* is connected between the terminals 296 and 299, the resistance of resistor 295*a* varies as a function of pressure sensed by the sensor.

Electronics 256' preferably includes an integrated circuit chip 350 of the type AD 537 manufactured by Analog Devices of Norwood, Mass., which converts the analog signals from the pressure sensor to a frequency modulated carrier signal for application to the transmitting antenna 258'. The chip 350 includes a voltage to frequency convertor 358, operational amplifier 354, and NPN transistor 356, a transistor driver 366, NPN transistor 368 and a source of reference voltage 360. The terminal 298 between resistors 295*c* and *d* of the bridge is coupled to the + input of amplifier 354. The terminal 296 between resistors 295*a* and *b* of the bridge is coupled through resistor 352 to the − input of amplifier 354. The output of amplifier 354 is connected to the base electrode of transistor 356. The emitter electrode of transistor 356 is coupled to the junction between resistor 352 and the − input of amplifier 354. The collector electrode of transistor 356 is connected to the control input of voltage to frequency convertor 358. Voltage to frequency convertor 358 provides a signal through driver 366 to transistor 368 which signal has a frequency that is proportional to the current supplied through transistor 354. Battery 254 applies an output of approximately +6 volts potential at the +V output. Resistor 362 is selected to cause a voltage of approximately +1 volts to accure at terminal 299 of the bridge. The internal reference generated at the output to convertor 358 by V reference 360 will be proportional to the signal at terminal 299. Preferably the resistor 362 is approximately 1750 OHMS with a pressure sensing resistor 295*a* value of approximately 350 OHMS. As a result a small amount of current is drawn from the voltage reference at terminal 299.

The output, at which the resultant frequency signals are formed by the convertor 358, is coupled through driver 366 to the base electrode of transistor 368. The transistor 368 operates in a switching mode. The emitter electrode of transistor 368 is connected to ground, whereas collector electrode, of the transistor is connected by conductor 385 through a current limiting resistor 372 to one side of the coil in the transmitting antenna 258'. The opposite side of the coil of the transmitting antenna 258' is connected to the +V output of the battery 254. As a result the frequency modulated signals formed by the convertor 358 cause the transistor 368 to form signals in the coil of the transmitting antenna 258' causing it to form electromagnetic fields, which are picked up by the corresponding receiving antenna.

Diode 374 is connected in parallel with resistor 372 and the coil of transmitting antenna 258 and limits voltage at the collector of transistor 368 as well as provides a discharge path for current in coil 258' when transistor 368 is switched off. Resistor 372 is a current limiting resistor in both the charge and discharge cycles and also sets the resistance inductance time constant. The battery 254 is preferably three high temperature lithium battery cells with unregulated voltage, but the voltage must be greater than 5 volts DC. With this arrangement the sensor electronics and transmitting antenna can be run directly from a battery type power supply 254 and the chip is relatively insensitive to supply voltage variations.

Figure 26:
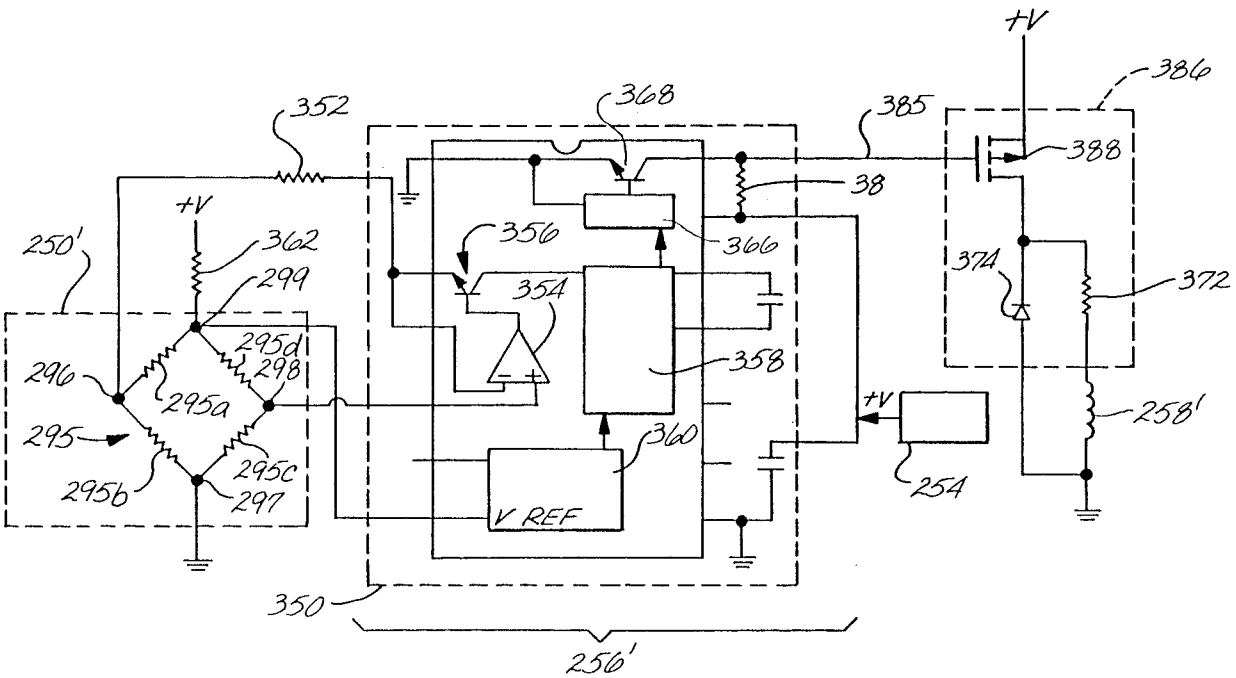
FIG. 26 is a schematic and block diagram similar to FIG. 25 modified to produce a stronger signal in the annulus.
Figure 27:
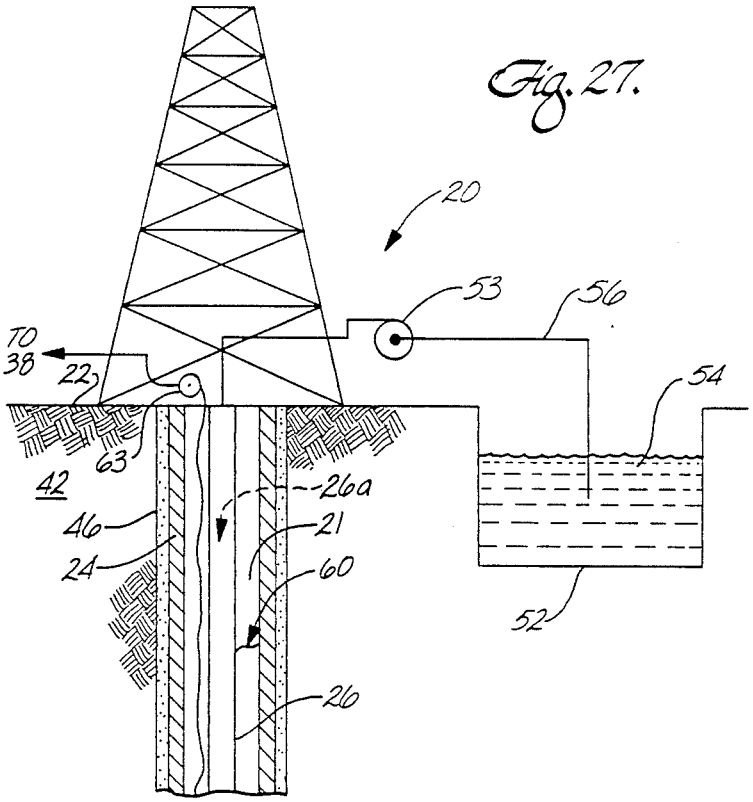
FIG. 27 is a schematic diagram similar to FIG. 1 with the sensor and transmitter mounted on the tubing string and an inflatable perforation wash tool mounted on the lower end of the tubing string with the wash tool deflated and deactuated.
Figure 27:
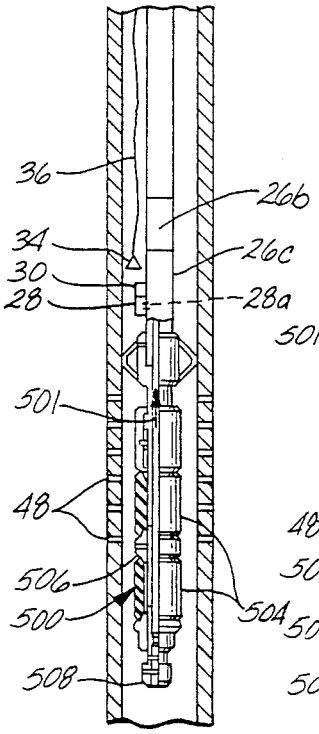

The circuit of FIG. 26 is essentially the same as FIG. 25 except that it is modified to provide greater amplification to the signals being sent by the transmitting antenna and hence greater output power so that the signals can be transmitted over a larger separation between the transmitting antenna and the receiving antenna. In this regard a MOSFET transistor amplifier 388, is provided with its control electrode connected to output conductor 385 and its output electrodes connected between the +V output of battery 254 and the junction between diode 374 and resistor 372. The junction of diode 374 and the coil of the transmitting antenna 258' are connected to the ground conductor for the power supply 254. In addition, a pull up resistor 389 is connected between the control electrode of transistor 368 and the +V output of the power supply 254.

Where there is a closely spaced relation between the transmitter and receiver, the transmitter may transmit and the receiver may receive optical signals or acoustic signals.

FIGS. 27, 28, 29 and 30 depict a schematic of an oil or gas well similar to that depicted in FIG. 1 but with the packer replaced by an inflatable perforation wash tool. The same reference numerals used in FIG. 1 are used to identify the same elements in FIG. 27 and the description, thereof, is therefore not repeated. The following description is principally directed to the new portions of the figure. An inflatable perforation wash tool 500 is mounted, preferably threaded, on the lower end of the tubing string 26. Additionally, the transmitter 28 and sensor 30 are mounted on the tubing string, by way of example, to the annular member immediately above the wash tool. The sensor 30 is connected to the central passage of the tubing string 26 by an opening indicated generally at 28*a*.

The wash tool is of the type manufactured by Lynes, Inc. disclosed at volume 5, page 5658 and 5659 of the Composite Catalog of the Oil Field Equipment Services, 1982–1983, published by World Oil.

The wash tool is shown in full along the right hand side, its longitudinal axis, of each of FIGS. 27 through 30 and in cross section along the left hand side thereby revealing a central passage 501 which runs the length of the wash tool. The wash tool also includes inflators or seal elements 504 which are shown in a deflated condition in FIGS. 27 and 30 and in an inflated condition in FIGS. 28 and 29. A perforation wash port 506 extends radially out 501 to the annulus around the exterior of the wash tool.

Figure 28:
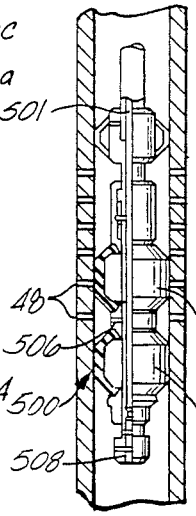
FIG. 28 depicts the lower portion of FIG. 26 including the casing and the perforations and depicts the wash tool with the inflatable element inflated into tight engagement with the inner wall of the casing.
Figure 29:
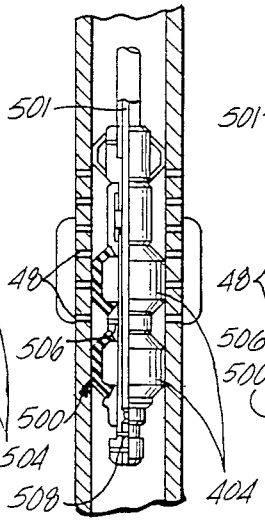
FIG. 29 is a view similar to FIG. 28 after the tubing string has been raised to actuate the wash tool and fluid is passed down the central passage of the tubing string through the wash tool and through perforations to an adjacent formation.

In operation the string of annular members or tubing string 26 are assembled end to end at the top of the well, the wash tool is threaded in place to the lower end of the drill string, and the sensor 30 and transmitter 28 are attached to the tubular member which, preferably is adjacent to the wash tool. The drill string is then moved with the wash tool, sensor and transmitter longitudinally in the well bore. When the wash tool 500 reaches the desired position at the bottom of the perforations 48, the movement is stopped and the pressure of the fluid in the central passage of the drill string is increased causing the sealing elements 504 on the wash tool to inflate and seal against the inside wall of the casing as depicted in FIG. 28. In this wash port 406 (and others not shown) is in fluid communication in a radial direction, between 2 adjacent inflators, with one or more perforations. With the pressure in the central passage of tubing string 26 maintaining the sealing condition, the tubing string 26 is lowered actuating the wash tool and thereby causing the lower end of the wash tool at 508 to close and causing internal passages between the sealing element and the central passage to close and trap the inflating fluid within the sealing elements as depicted in FIG. 29. As depicted in FIG. 29, fluid in the central passage of the tubing string is then pulsed and passed down through the wash tool and out through the washing port 506 (and others not shown) through one or more of the perforations 48, into the formation adjacent to the perforations. As a result, the perforations through the casing are cleaned or flushed to provide better production of hydrocarbons.

The wash fluid is passed down the central passage under high pressure and preferably pulsed at high rates so as to cause intermittent streams of water to be passed through the perforations to thereby better clean the perforations. It is during this time that it is desirable to sense the pressure of the fluid. To this end the sensor 30 senses the pressure parameter in the central passage of the tubing string. This pressure is approximately equal to the pressure of the fluid being passed through the washing port. The transmitter 28 transmits pressure parameter representative data signals into the annulus 21.

The receiver 34 is suspended from the lower end of the wire line and is lowered longitudinally along the well bore in the annulus to a position where the receiver is within range of and receives the pressure parameter data signals in the annulus. Data signals, which represent the pressure parameter, are passed over the wire line up to the top of the well bore. The construction and operation of the sensor, transmitter, receiver and wire line may be of the electrode type or the magnetic field type disclosed above. However, if the electrode type is used, a conductive fluid is required in the annulus.

Figure 30:
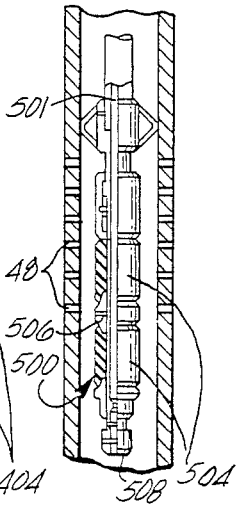
FIG. 30 is a view similar to FIG. 27 with the wash tool deactuated and the inflating elements deflated.

After the perforations adjacent the washing port have been adequately cleaned the tubing string 26 is raised deactuating the wash tool and thereby unblocking the ports between the sealing elements and the central passage, blocking the passage from the central passage through the wash ports and unblocking the lower end of the central passage at 408 allowing the sealing elements to deflate to the conditions depicted in FIG. 30.

Preferably, the drill string, sensor, transmitter and wash tool are incrementally moved up to higher perforations above the one or ones washed. The wash tool is again actuated, fluid is again passed through the wash ports to clean out the higher perforations. The wire line, including the receiver, are raised thus following the transmitter to the new position for receiving the parameter pressure data signals transmitted by the transmitter. After washing of the higher perforations the wash tool is deactuated and then the drill string and wire line are then incrementally moved to a still higher position for repeating the aforementioned process for cleaning another group of perforations.

Thus, as the drill string, sensor and transmitter are incrementally moved upward and operations are performed by the wash tool at each incremental position. The operation being inflation, actuation and passing cleaning fluid through adjacent perforations. As the drill string and hence the sensor, transmitter and wash tool are moved to each new position the wire line and suspended receiver are moved so as to follow the transmitter to the new position for receiving the pressure parameter data signals.

It should be noted that the above are preferred configurations, but others are foreseeable. The described embodiments of the invention are only considered to be preferred and illustrative of the inventive concepts. The scope of the invention is not to be restricted to such embodiments. Various and numerous other arrangements may be devised by one skilled in the art without departing from the spirit and scope of the invention.

What is claimed is:

1. A method for recovery of data in an oil or gas well having a well bore for passing fluid, transversely across a side of the well bore at a down hole location of the well bore and longitudinally in the well bore, between a geological formation located at the down hole location and a top portion of the well bore, the method comprising the steps of:

(a) sensing with a sensor substantially at the down hole location, while the fluid is flowing across the side, a parameter of the fluid;

(b) transmitting into the well bore with a transmitter, data signals which represent the sensed parameter;

(c) lowering in the well bore separate from the sensor and transmitter, a receiver and a flexible line while the receiver is suspended from the flexible line;

(d) receiving the data signals with the receiver; and (e) passing data signals which represent the parameter which is represented by the data signals, received by the receiver, over the flexible line to the top portion of the well bore.

2. The method of claim 1 wherein the step of transmitting comprises the step of transmitting the data signals with the transmitter located substantially from the down hole location.

3. The method of claim 1 wherein a string of annular members are positioned in the well bore for passing the fluid between the top portion and a lower portion of the well bore, and wherein the step of lowering the receiver and flexible line comprises the step of lowering the receiver and flexible line in an annulus left between the string of members and the well bore.

4. The method of claim 3 wherein the step of sensing with the sensor comprises the step of sensing the parameter in a central passage of the string of members.

5. The method of claim 4 wherein the step of sensing the parameter comprises the step of sensing the parameter in the fluid in the central passage through a side of the string of members.

6. The method of claim 3 comprising the steps of lowering the string of annular members in the well bore while having the sensor mounted on the string of members until the sensor is substantially at the down hole location.

7. The method of claim 3 or 6 comprising the step of lowering the string of members in the well bore with the transmitter mounted on the string of members.

8. The method of claim 6 wherein the step of lowering the string of members comprises the step of lowering the string of members with the sensor mounted exterior to the central passage of the string of members.

9. The method of claim 3 or 6 wherein the string of annular members comprises an electrically conductive member and wherein the step of transmitting comprises the step of conducting with the transmitter a signal along at least a portion of the conductive member.

10. The method of claim 3 comprising the step of lowering the string of members with the transmitter mounted exterior to the central passage of the string of members.

11. The method of claim 3 comprising the step of sensing fluid pressure within the string of members with the sensor.

12. The method of claim 3 wherein the steps of lowering the string of members comprises the step of lowering the string of members having, connected thereto, means for substantially closing off the annulus, and actuating the annulus closing means to close off the annulus between the string of members and the bore hole at a desired location substantially above the down hole location.

13. The method of claim 12 wherein the step of lowering the receiver and flexible line are performed subsequent to the step of actuating the annulus closing means.

14. The method of claim 3 wherein the sensor and transmitter are mounted together in a single module and comprising the step of releasing the module and allowing it to pass down the inside of the string of members.

15. The method of claim 3 wherein the string of annular members comprises an electrically conductive member and the transmitter comprises a toroidal coil positioned about the conductive member and wherein the step of lowering the transmitter comprises the step of lowering the string of annular members with the toroidal coil positioned about the conductive member.

16. The method of claim 15 wherein the step of transmitting comprises the step of inducing a current along a portion of the conductive member.

17. A method of claim 3 comprising the step of moving the string of members, having a tool, the sensor and the transmitter mounted thereon, in and longitudinally along the well bore leaving the annulus between the string of members and the well bore.

18. The method of claim 17 wherein the sensor is adapted to sense pressure of fluid passed through the tool.

19. The method of claim 18 wherein casing is located in the well bore and comprises perforations at the down hole location, and comprising the step of positioning the string of members with the tool adjacent a perforation and passing fluid through said string of members and tool to said perforation.

20. The method of claim 17, wherein the step of moving the string of annular members comprises the step of moving the string of members so as to move the tool, the sensor and the transmitter longitudinally along a plurality of positions and the step of moving the flexible line and receiver line comprises the step of following the transmitter with the receiver by moving the flexible line in and longitudinally along the well bore such that the receiver is within range for receiving the data signals formed by the transmitter.

21. The method of claim 17 or 20 wherein the step of moving the string of members comprises the step of incrementally moving the string of members so as to move the tool to each of a plurality of positions and the step of moving the flexible line comprises the step of moving the flexible line, with each said incremented movement of the string of members, so that the receiver is thereafter in range for receipt of the data signals from the transmitter.

22. The method of claim 21 comprising the step of actuating the tool in the well bore following each of a plurality of said incremental movements of the string of members.

23. The method of claim 17 comprising the step of entering the sensor and transmitter into the wall bore carried by the string of members as the string is moving down the well bore.

24. The method of claim 17 comprising the step of entering the receiver into the well bore suspended from the flexible line as the flexible line is moved down in the well, bore.

25. The method of claim 1 comprising the step of sensing fluid pressure with the sensor.

26. The method of claim 1, 3 or 25 wherein the well bore contains an electrically conductive fluid for contact with the receiver and the steps of transmitting and receiving comprise, respectively, the steps of transmitting and receiving while the receiver is in contact with conductive fluid.

27. The method of claim 26 wherein the transmitter comprises an elongated electrical member and wherein the step of transmitting comprises the step of inducing currents, along the length of the elongated member, representative of the sensed parameter.

28. The method of claim 1, 3 or 25 wherein the step of transmitting and receiving comprise, respectively, the steps of creating electrical potentials in a conductive fluid in contact with the receiver which represent a parameter sensed by the sensor and receiving the electrical potentials.

29. The method of claim 28 wherein the transmitter comprises a coil and wherein the step of transmitting with the transmitter comprises the step of forming the data signals received by the receiver with the coil.

30. The method of claim 1, 3 or 25 wherein the step of transmitting data signals comprises the step of forming magnetic fields representative of the sensed parameter.

31. The method of claim 1, 3 or 25 wherein the well bore comprises casing therein with at least one opening there through at the down hole location for the passage of the fluid to the formation adjacent the at least one opening and wherein the step of transmitting is carried out during the passage of the fluid through the at least one opening.

32. The method of claim 1, 3 or 25 wherein the step of lowering the receiver and flexible line comprises the step of lowering the flexible line with at least one insulated conductor therein and wherein the step of passing the data signals over the flexible line comprises the step of conducting such data signals over the at least one insulated conductor.

33. The method of claim 32 wherein the flexible line comprises a further conductor extending to the top of the well bore and comprising the step of forming the data signals, which are conducted to the top of the well bore, between the at least one insulated conductor and the further conduction.

34. The method of claim 32 comprising the step of coupling the received data signals to the at least one insulated conductor for conduction to the top of the well bore.

35. The method of claim 1, 3 or 25 comprising the step of receiving with the receiver, as the received data signals, electrical potentials.

36. The method of claim 1, 3 or 25 comprising the step of receiving with the receiver, as the received data signals, a magnetic field.

37. The method of claim 1 wherein the sensor and transmitter are mounted together in a single module and comprising the step of releasing the module and allowing it to pass, unsupported on the string of members, down the inside of the well bore.

38. The method of claim 1 wherein the step of lowering the receiver comprises the step of lowering the line with the receiver supported substantially only with the line.

39. The method of claim 1 wherein the step of transmitting comprises the step of transmitting variable frequency data signals representative of the parameter.

40. The method of claim 1 wherein the step of transmitting comprises the step of transmitting digitally coded data signals representative of the parameter.

41. The method of claim 1 further comprising the steps of amplifying the data signals, passed by the line, at the top portion of the well bore.

42. The method of claim 1 comprising the step of preamplifying the data signals which are passed to the top portion of the well bore before they are passed over the flexible line.

43. The method of claim 1 wherein the data signals received by the receiver are amplified and demodulated to produce the data signals for passing over the flexible line.

44. The method of claim 1 comprising the step of fracturing the formation, while performing the steps of transmitting and receiving, by passing, as the fluid, a fracture fluid down the well bore and then transversely across a side of the well bore between up hole and down hole extremities of a zone located at the down hole location.

45. The method of claim 44 wherein the step of lowering the receiver and the flexible line and comprises the step of lowering the flexible line until the receiver is at a position, for the step of receiving, which is substantially up hole from the zone up hole extremity and comprising the step of lowering the sensor and transmitter to a position for sensing and transmitting which is substantially down hole from the zone down hole extremity.

46. The method of claim 45 wherein the step of lowering the flexible line and receiver comprises the step of positioning the receiver at a location displaced away from in front of the zone and up hole from the zone up hole extremity.

47. The method of claim 44, 44 or 46 wherein the step of positioning the sensor and transmitter comprises the step of positioning the sensor and transmitter at a position displaced away from in front of the zone down hole and substantially down hole from the zone down hole extremity.

48. In combination with an oil or gas well having a well bore in which fluid is passed, transversely across a side of the well bore at a down hole location of the well bore and longitudinally in the well bore, between a geological formation located at the down hole location and a top portion of the well bore, means for recovering data from the well, the combination comprising:

(a) means for sensing with a sensor substantially at the down hole location, while the fluid is flowing across the side, a parameter of the fluid;

(b) means for transmitting into the well bore with a transmitter, data signals which represent the sensed parameter;

(c) a flexible line and a receiver of the data signals suspended from the flexible line; and (d) means for lowering in the well bore separate from the sensor and transmitter, the receiver and the flexible line while the receiver is suspended from the flexible line, the flexible line being adapted for passing data signals, which represent the parameter which is represented by the data signals received by the receiver, to the top portion of the well bore.

49. The combination of claim 48 wherein the transmitter is located substantially at the down hole location.

50. The combination of claim 48 comprising a string of annular members positioned in the well bore for passing the fluid between the top portion and a lower portion of the well bore, and the means for lowering comprises means for lowering the receiver and flexible line in an annulus formed between the string of members and the well bore.

51. The combination of claim 50 wherein the sensor comprises means for sensing the parameter in a central passage of the string of members.

52. The combination of claim 51 wherein the sensor senses the parameter in the fluid through a side of the string of members.

53. The combination of claim 50 wherein the sensor is mounted on the string of members substantially at the down hole location.

54. The combination of claim 50 or 53 wherein the transmitter is mounted on the string of members substantially at the bottom hole location.

55. The combination of claim 53 wherein the sensor is mounted exterior to the central passage of the string of members.

56. The combination of claim 50 or 53 wherein the transmitter is mounted exterior to the central passage of the string of members.

57. The combination of claim 48 or 50 wherein the sensor comprises a pressure sensor.

58. The combination of claim 50 wherein the string of members comprises, connected thereto, means for substantially closing off the annulus, the annulus closing means being operable to close off the annulus between the string and the well bore substantially above the down hole location.

59. The combination of claim 50 wherein the sensor and transmitter are mounted together in a single module adapted for releasing and passing down the inside of the spring of members.

60. The combination of claim 48 or 50 comprising an electrically conductive fluid in the bore hole in contact with the receiver.

61. The combination of claim 48 or 50 wherein the transmitter comprises means for forming magnetic fields representative of the sensed parameter.

62. The combination of claim 48 or 50 wherein the well hole comprises casing therein with at least one opening for the passage of fluid to the formation adjacent the at least one opening and wherein the transmitter is adapted for transmitting during the passage of the fluid through the at least one opening.

63. The combination of claim 50 wherein the string of annular members comprises an electrically conductive member and wherein the transmitter comprises means for conducting a signal along at least a portion of the conductive member.

64. The combination of claim 63 wherein the transmitter comprises a toroidal coil mounted on and positioned about the conductive member.

65. The combination of claim 48 or 50 wherein the flexible line comprises at least one insulated conductor extending to the top portion of the well bore for conducting the passed data signals to the top portion of the well bore.

66. The combination of claim 65 wherein the flexible line comprises a further conductor extending to the top of the well bore, and wherein said data signals conducted to the top of the well bore are formed between the at least one conductor and the further conductor.

67. The combination of claim 65 wherein the received data signals are coupled to the at least one conductor for conduction to the top of the well bore.

68. The combination of claim 48 or 50 wherein the receiver is adapted to receive electrical potentials, from fluid, as the received data signals.

69. The combination of claim 48 or 50 wherein the receiver is adapted to receive magnetic fields as the received data signals.

70. The combination of claim 48 or 50 wherein the receiver comprises at least one electrode which is exposed to conductive fluid.

71. The combination of claim 48 or 50 wherein the at least one electrode comprises first and second spaced apart electrodes exposed to the fluid for receiving electrical potentials as the data signals.

72. The combination of claim 71 wherein the flexible line comprises at least one insulated conductor and a further conductor extending to the top portion of the well bore, electrical potentials corresponding to those received on the first and second electrodes being formed between the at least one conductor and the further conductor for conduction to the top of the well bore.

73. The combination of claim 72 wherein the first and second spaced apart electrodes are arranged on the receiver so that one is at an up hole position relative to the other one in the well bore.

74. The combination of claim 71 wherein the first and second spaced apart electrodes are arranged on the receiver so that they are in transverse positions relative to each other with espect to the well bore.

75. The combination of claim 48 or 50 wherein the receiver comprises a coil.

76. The system of claim 50 wherein the sensor, the transmitter and a tool are mounted on the string of members.

77. The system of claim 76 wherein the sensor is adapted for sensing pressure of the fluid.

78. The system of claim 76 wherein the well bore comprises casing having perforations at said down hole position and wherein said tool comprises a port for passing fluid from said string of members to one of said perforations in the casing.

79. The system of claim 76 or 78 wherein the tool comprises means actuatable, in the well bore, into engagement with the inside of the well bore.

80. The system of claim 76 wherein the tool comprises a perforation wash tool.

81. The system of claim 48 or 50 wherein the flexible line comprises a wire line comprising an insulated conductor and an exterior metal sheath.

82. The system of claim 48 or 50 wherein the flexible line comprises a wire line comprising an insulated conductor and an exterior metal sheath and the receiver is suspended from the sheath.

83. The combination of claim 48 wherein the sensor and transmitter are mounted together in a single module for releasing and passing down the well bore separate from the string of members.

84. The combination of claim 48 wherein the transmitter comprises a coil for forming the data signals for receipt by the receiver.

85. The combination of claim 48 wherein the transmitter comprises an elongated conductive member and the transmitter is adapted for inducing currents along the length of the elongated member representative of the sensed parameter.

86. The combination of claim 85 wherein the elongated conductive member is non-conductive along substantially the length of the exterior thereof.

87. The combination of claim 86 comprising electrically conductive members in the opposite ends of said elongated member exposed for conducting current into the fluid.

88. The combination of claim 48 wherein the flexible line is substantially the only support for the receiver.

89. The combination of claim 48 wherein the transmitter comprises means for transmitting variable frequency data signals representative of the parameter.

90. The combination of claim 48 wherein the transmitter comprises means for transmitting digitally coded data signals representing the parameters.

91. The combination of claim 48 further comprising means for amplifying the data signals, passed by the flexible line, at the top portion of the well bore.

92. The combination of claim 48 comprising means for preamplifying the data signals passed up to the top portion of the well bore before such data signals are passed over the flexible line.

93. The combination of claim 48 or 92 wherein the transmitter comprises means for creating and the receiver comprises means for receiving, electrical potentials in a conductive fluid in contact with the receiver which represent a parameter sensed by the sensor.

94. The combination of claim 48 comprising means for amplifying and demodulating the data signals received by the receiver to produce data signals for passing over the flexible line to the top portion of the well bore.

95. The combination of claim 48 comprising means operative, while transmitting and receiving, for passing, as the fluid, a fracture fluid down the well bore for passing the fracture fluid, transversely across the side of the well bore between up hole and down hole extremities of a well bore zone, located at the down hole location, and into the formation to thereby fracture the formation.

96. The combination of claim 95 wherein the receiver is positioned, for receiving the data signals, substantially up hole from the zone up hole extremity and the sensor and transmitter are positioned for sensing and transmitting substantially down hole from the zone down hole extremity.

97. The combination of claim 96 wherein the receiver is displaced from in front of the zone up hole from the zone upper extremity.

98. The combination of claim 95 or 96 wherein the sensor and transmitter are displaced away from in front of the zone down hole from the zone lower extremity.

* * * * *

UNITED STATES PATENT AND TRADEMARK OFFICE

CERTIFICATE OF CORRECTION

PATENT NO. : 4,763,520

DATED : August 16, 1988

INVENTOR(S) : Paul F. Titchener et al.

It is certified that error appears in the above-identified patent and that said Letters Patent is hereby corrected as shown below:

In the Specification

| | |
|---|---|
| Column 1, Line 14 | Change "disclosure" to -- disclose --. |
| Column 1, Line 55 | Change "reliability" to -- reliably --. |
| Column 2, Line 30 | After "parameter" and before "is", delete the comma. |
| Column 3, Line 39 | After "is" and before "very", delete -- a --. |
| Column 4, Line 64 | Change "takan" to -- taken --. |
| Column 4, Line 65 | Change "1313" to -- 13-13 --. |
| Column 5, Line 17 | Change "1717" to -- 17-17 --. |
| Column 5, Line 44 | After "processing" and before "display", delete the comma. |
| Column 6, Line 38 | Before "interior", change "and" to -- an --. |
| Column 7, Lines 17&18 | After "annulus 21", delete "by means of, and supported at the lowered down the annulus 21 by means of and". |
| Column 8, Line 8 | Change "he" to -- the --. |
| Column 8, Line 47 | Change "insulting" to -- insulating --. |

UNITED STATES PATENT AND TRADEMARK OFFICE

CERTIFICATE OF CORRECTION

PATENT NO. : 4,763,520

DATED : August 16, 1988

INVENTOR(S) : Paul F. Titchener et al.

It is certified that error appears in the above-identified patent and that said Letters Patent is hereby corrected as shown below:

| | |
|---|---|
| Column 9, Line 13 | Change "of-a" to -- of a --. |
| Column 9, Line 34 | Change "some" to -- same --. |
| Column 9, Line 45 | After "line", delete "are" and insert therfor -- is --. |
| Column 12, Line 61 | Change "respectfully" to -- respectively --. |
| Column 13, Line 7 | Change "verticle" to -- vertical --. |
| Column 13, Line 9 | Change "respectfully" to -- respectively --. |
| Column 15, Line 31 | Change "respectfully" to -- respectively --. |
| Column 16, Line 24 | Before "both", insert -- are --. |
| Column 17, Line 35 | Change "modificiation" to -- modification --. |
| Column 17, Line 37 | Change "over all" to -- overall --. |
| Column 18, Line 3 | Before "more", delete -- the --. |
| Column 20, Line 42 | Change "preferrably" to -- preferably --. |
| Column 22, Line 45 | Change "In this wash" to -- Wash --. |
| Column 22, Line 57 | Change "washing" to -- wash --. |

UNITED STATES PATENT AND TRADEMARK OFFICE

CERTIFICATE OF CORRECTION

PATENT NO. : 4,763,520

DATED : August 16, 1988

INVENTOR(S) : Paul F. Titchener et al.

It is certified that error appears in the above-identified patent and that said Letters Patent is hereby corrected as shown below:

| | |
|---|---|
| Column 23, Line 41 | Before "operations", delete "and", and after "upward", insert -- , --. |

In the Claims

| | |
|---|---|
| Column 25, Line 49 | Change "wall" to -- well --. |
| Column 25, Line 55 | After "well", delete the comma. |
| Column 26, Line 16 | Change "there through" to -- therethrough --. |
| Column 27, Line 24 | Change "44" (second occurrence) to -- 45 --. |
| Column 28, Line 24 | Change "spring" to -- string --. |
| Column 29, Line 19 | Change "espect" to -- respect --. |
| Column 29, Line 34 | Change "actuatable" to -- actuable --. |

Signed and Sealed this

Twenty-eighth Day of February, 1989

*Attest:*

DONALD J. QUIGG

*Attesting Officer*

*Commissioner of Patents and Trademarks*